US010042300B2

(12) United States Patent
Endoh

(10) Patent No.: US 10,042,300 B2
(45) Date of Patent: Aug. 7, 2018

(54) IMAGE FORMING APPARATUS PERFORMING CONTACT CONTROL OR SEPARATION CONTROL OF PHOTOSENSITIVE DRUMS AND DEVELOPING ROLLERS

(71) Applicant: CANON KABUSHIKI KAISHA, Tokyo (JP)

(72) Inventor: Keisuke Endoh, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/702,593

(22) Filed: Sep. 12, 2017

(65) Prior Publication Data

US 2018/0074448 A1 Mar. 15, 2018

(30) Foreign Application Priority Data

Sep. 14, 2016 (JP) ..... 2016-179619

(51) Int. Cl.
*G03G 15/08* (2006.01)
*G03G 15/00* (2006.01)

(52) U.S. Cl.
CPC ..... *G03G 15/5008* (2013.01); *G03G 15/0813* (2013.01)

(58) Field of Classification Search
CPC ..... G03G 15/0813; G03G 15/5008; G03G 21/1857; G03G 21/1864; G03G 2221/1657
See application file for complete search history.

(56) References Cited

U.S. PATENT DOCUMENTS

2010/0316400 A1* 12/2010 Murasaki ..... G03G 15/0131 399/49
2010/0316413 A1* 12/2010 Murasaki ..... G03G 15/0194 399/228
2012/0014717 A1* 1/2012 Sugiyama ..... G03G 15/0121 399/228

FOREIGN PATENT DOCUMENTS

JP 2006292868 A 10/2006
JP 201118017 A 1/2011
JP 2012022142 A 2/2012
JP 2012-220733 A 11/2012

* cited by examiner

*Primary Examiner* — Thomas Giampaolo, II
(74) *Attorney, Agent, or Firm* — Canon U.S.A., Inc. IP Division

(57) ABSTRACT

A CPU selects which speed to execute a contact control of photosensitive drums and developing rollers of a plurality of process stations at, a normal speed or a speed higher than the normal speed. The CPU selects which speed to execute a separation control of the photosensitive drums and the developing rollers of the plurality of process stations at, a normal speed or a speed higher than the normal speed. The CPU further selects contact controls and separation controls so that a difference between the number of times of execution of the contact control at the speed higher than the normal speed and the number of times of execution of the separation control at the speed higher than the normal speed becomes less than or equal to a predetermined number of times.

13 Claims, 12 Drawing Sheets

IMAGE FORMING APPARATUS PERFORMING CONTACT CONTROL OR SEPARATION CONTROL OF PHOTOSENSITIVE DRUMS AND DEVELOPING ROLLERS

BACKGROUND

Field of the Disclosure

The present disclosure relates to an image forming apparatus of a contact developing method.

Description of the Related Art

Some image forming apparatuses include a plurality of image forming units for image formation, and sequentially transfer images formed on photosensitive drums of the respective image forming units onto an intermediate transfer belt opposed to the photosensitive drums or a sheet borne on a conveyed transfer belt. As a developing method used in such image forming apparatuses, there is known a contact developing method in which developing rollers serving as bearing members of developers (toner) are rotated in contact with the photosensitive drums so that toner adheres to electrostatic latent images formed on the photosensitive drums for development. According to the contact developing method, the developing rollers and the photosensitive drums are driven to rotate in contact with each other. Both the photosensitive drums and the developing rollers wear due to friction between the photosensitive drums and the developing rollers. If the photosensitive drums and the developing rollers continue to be in the contact state more than needed, the life of the photosensitive drums and the developing roller expires earlier. Then, for example, Japanese Patent Application Laid-Open No. 2006-292868 discusses a configuration in which developing rollers and photosensitive drums of image forming units can be brought into contact and separated in a sequential manner. However, the configuration discussed in Japanese Patent Application Laid-Open 2006-292868 can cause unnecessary contact between the photosensitive drums and the developing rollers, depending on the contents of a print job. Japanese Patent Application Laid-Open No. 2012-022142 discusses control for reducing unnecessary contact time by improving control of a motor that switches the contact and separated states of the developing rollers and the photosensitive drums.

If the control discussed in the foregoing Japanese Patent Application Laid-Open No. 2012-022142 is performed, differences can occur between the contact times of the photosensitive drums and the developing rollers of the image forming units. If there is a difference between the contact times of the respective image forming units, the image forming units become uneven in the amounts of wear of the photosensitive drums and the amounts of wear of the developing rollers. The photosensitive drums and the developing rollers constituting the image forming units are integrated as process cartridges. There can occur a problem that the times to replace the process cartridges vary from one image forming unit to another, and image quality degrades quickly due to wear of the process cartridge of which the amount of wear is high.

SUMMARY

According to an aspect of the present disclosure, an image forming apparatus includes a plurality of image forming units including respective photosensitive drums, and developing rollers configured to develop latent images formed on the photosensitive drums, a contact/separation unit configured to shift the photosensitive drums and the developing rollers of the plurality of image forming units from a separated state to a contact state or from the contact state to the separated state, a driving unit configured to drive the contact/separation unit, and a control unit configured to execute a first contact control, in which the driving unit is driven at a first speed and the photosensitive drums and the developing rollers of the plurality of image forming units are shifted from the separated state to the contact state, or a second contact control, in which the driving unit is driven at a second speed higher than the first speed and the photosensitive drums and the developing rollers of the plurality of image forming units are shifted from the separated state to the contact state, and execute a first separation control, in which the driving unit is driven at a third speed and the photosensitive drums and the developing rollers of the plurality of image forming units are shifted from the contact state to the separated state, or a second separation control, in which the driving unit is driven at a fourth speed higher than the third speed and the photosensitive drums and the developing rollers of the plurality of image forming units are shifted from the contact state to the separated state, wherein the control unit is configured to select which contact control to execute, the first contact control or the second contact control, and which separation control to execute, the first separation control or the second separation control, according to a size of a sheet for image formation, and wherein the control unit is configured to select the contact control and the separation control so that a difference between a number of times of execution of the second contact control and a number of times of execution of the second separation control becomes less than or equal to a predetermined number of times.

The present disclosure has been achieved in view of the foregoing circumstances. The present disclosure is directed to reducing unnecessary contact times of the photosensitive drums and the developing rollers of the image forming units, and reducing unevenness in the contact times of the photosensitive drums and the developing rollers of the image forming units.

Further features of the present disclosure will become apparent from the following description of exemplary embodiments with reference to the attached drawings.

DESCRIPTION OF THE EMBODIMENTS

An exemplary embodiment of the present disclosure will be described in detail below with reference to the drawings. Members described in the exemplary embodiment are just examples. The scope of the present disclosure is not limited thereto unless otherwise specified.

<Overview of Image Forming Apparatus>

Figure 1A:
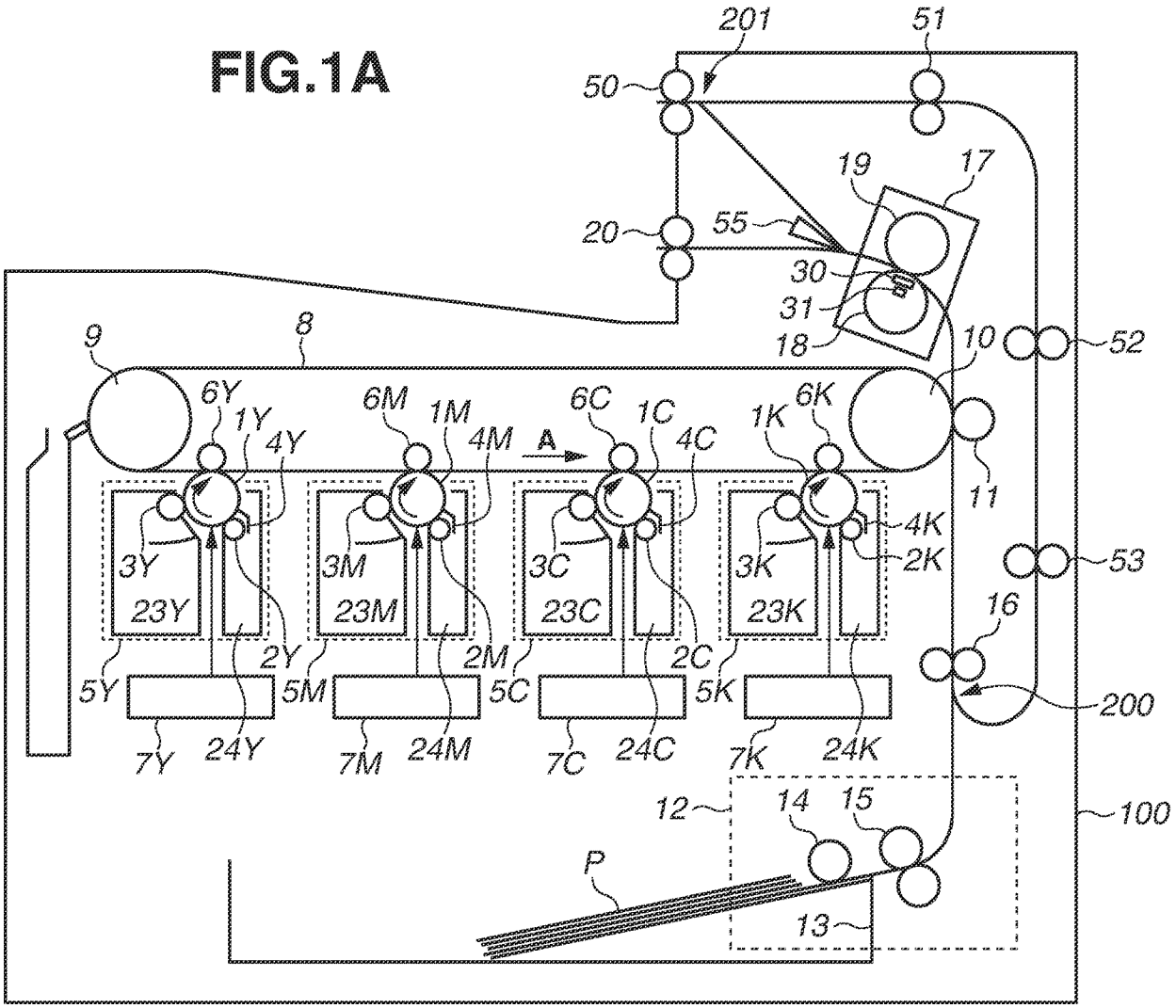
FIGS. 1A and 1B are a schematic sectional view and a system block diagram of an image forming apparatus according to one or more aspects of the present disclosure.

An overview of an overall configuration of an image forming apparatus according to a first exemplary embodiment will be given with reference to FIG. 1A. The image forming apparatus according to the present exemplary embodiment is a laser printer using an electrophotographic image formation process. FIG. 1A illustrates a color laser printer 100 (hereinafter, referred to as a printer 100) which includes detachable image forming units or process stations (may be referred to as process cartridges, or simply as stations) 5Y, 5M, 5C, and 5K illustrated by dotted-lined frames. The four process stations 5Y, 5M, 5C, and 5K are similar in structure but different in forming images in different toner colors, or more specifically, by using yellow (Y), magenta (M), cyan (C), and black (K) toners (developers). The symbols Y, M, C, and K will hereinafter be omitted unless a specific process station or stations are described. The process stations 5 each include a toner container 23, a photosensitive drum 1, a charging roller 2, a developing roller 3 serving as a developing unit, a cleaning blade 4, and a waste toner container 24. Exposure devices 7 are arranged below the respective process stations 5. The exposure devices 7 expose the photosensitive drums 1 based on an image signal.

The charging rollers 2 are driven to rotate by rotation of the photosensitive drums 1, and charge the photosensitive drums 1 to a predetermined polarity and potential. The photosensitive drums 1 charged to the predetermined potential are then exposed by the exposure devices 7, whereby electrostatic latent images corresponding to yellow, magenta, cyan, and black, respective color components are formed. The exposure devices 7 used in the present exemplary embodiment are scanners in which a laser beam emitted from a laser diode is deflected by a rotating polygon mirror. The exposure devices 7 focus the respective laser beams modulated according to image information upon the photosensitive drums 1 to form the electrostatic latent images. The exposure of the photosensitive drums 1 by the exposure devices 7 is performed with a predetermined time of delay from a position signal (beam detector (BD) signal) scan line by scan line in a main scanning direction (direction orthogonal to a conveyance direction of a sheet). When forming an image on a sheet, the process stations 5 perform exposure at predetermined time intervals in a sub scanning direction (conveyance direction of the sheet). With such a configuration, the process stations 5 constantly perform exposure on the same positions of the photosensitive drums 1 to suppress color misregistration.

The electrostatic latent images formed on the photosensitive drums 1 are developed by the developing rollers 3 of the respective process stations 5. The developing rollers 3 make respective color toners adhere to the electrostatic latent images on the photosensitive drums 1 to develop toner images. The toner in each developing device is negatively-charged nonmagnetic one-component toner. The electrostatic latent images are developed by a nonmagnetic one-component contact developing method. A developing voltage is applied to the developing rollers 3 from a not-illustrated developing voltage power supply. In such a manner, the toners adhere to the electrostatic latent images formed on the photosensitive drums 1 for development.

An intermediate transfer belt unit includes an intermediate transfer belt 8 serving as an intermediate transfer member, a driving roller 9, and a secondary transfer counter roller 10. Primary transfer rollers 6 are arranged inside the intermediate transfer belt 8, opposite to the respective photosensitive drums 1. A primary transfer voltage of positive polarity is applied to the primary transfer rollers 6 from a primary transfer voltage power supply (not illustrated). A motor (not illustrated) rotates the driving roller 9, whereby the intermediate transfer belt 8 is rotated. The secondary transfer counter roller 10 is driven to rotate by the rotation of the intermediate transfer belt 8. The photosensitive drums 1 rotate in the directions of the arrows in FIG. 1A (clockwise). The intermediate transfer belt 8 rotates in the direction of the arrow A in FIG. 1A. The photosensitive drums 1 and the intermediate transfer belt 8 rotate in contact with each other, and the primary transfer voltage of positive polarity is applied to the primary transfer rollers 6. The toner images on the photosensitive drums 1 are thereby sequentially transferred onto the intermediate transfer belt 8 in order from the toner image on the photosensitive drum 1Y. The four color toner images on the intermediate transfer belt 8 are conveyed to the secondary transfer roller 11 in the superposed state. The cleaning blades 4 of the photosensitive drums 1 are pressed against the photosensitive drums 1 to remove residual toner that remains on the photosensitive drums 1 without being transferred onto the intermediate transfer belt 8.

A feed and conveyance device 12 includes a feed roller 14 and a feed and conveyance roller pair 15. The feed roller 14 feeds a sheet P from inside a feed cassette 13 in which sheets P are stored. The feed and conveyance roller pair 15 conveys the fed sheet P. The sheet P conveyed from the feed and conveyance device 12 is conveyed to the secondary transfer roller 11 by a registration roller pair 16. A voltage of positive polarity is applied to the secondary transfer roller 11, whereby the four color toner images on the intermediate transfer belt 8 are transferred onto the conveyed sheet P.

The sheet P onto which the toner images are transferred is conveyed to a fixing device 17. The fixing device 17 is a fixing device of a film heating method, including a fixing roller 18 and a pressure roller 19. A fixing heater 30 and a temperature sensor 31 for measuring a temperature of the fixing heater 30 are built in the fixing roller 18. The pressure roller 19 is to be pressed against the fixing roller 18. The fixing device 17 applies heat and pressure to the sheet P, whereby the toner images are fixed to the sheet P. The resulting image formation product (printed sheet) is discharged out of the printer 100 (out of the image forming apparatus).

In two-sided printing, the sheet P past the fixing device 17 is not discharged out of the image forming apparatus and printing is performed on a second side of the sheet P. In such a case, the sheet P past the fixing device 17 is conveyed toward a reversing point 201. A two-sided flapper 55 can switch the conveyance direction of the sheet P between an outside discharge direction (toward a discharge roller 20) and a reversing unit direction (toward the reversing point 201). In performing two-sided printing, the two-sided flapper 55 is switched to the reversing unit direction before the leading edge of the sheet P on a first side of which an image is formed reaches the two-sided flapper 55. The sheet P passes the reversing point 201, and is then conveyed in the outside discharge direction by a reversing roller pair 50. If the trailing edge of the sheet P passes the reversing point 201, the reversing roller pair 50 is once stopped while the sheet P is sandwiched between the reversing roller pair 50. The reversing roller pair 50 is then rotated in a reverse rotation direction, whereby the sheet P is conveyed toward a two-sided conveyance path on which roller pairs 51 to 53 are arranged. The sheet P is conveyed through the two-sided conveyance path by the roller pairs 51 to 53 arranged on the two-sided conveyance path. The two-sided conveyance path joins the conveyance path between the feed and conveyance roller pair 15 and the registration roller pair 16 at a junction point 200. The sheet P conveyed through the two-sided conveyance path and flipped over is conveyed to the secondary transfer roller 11 by the registration roller pair 16. Toner images on the intermediate transfer belt 8 are then transferred onto the second side of the sheet P. The fixing device 17 fixes the toner images transferred onto the second side to the sheet P. The two-sided flapper 55 is switched to the outside discharge direction, whereby the sheet P on the two sides of which the images are formed is discharged out of the image forming apparatus.

<System Configuration of Image Forming Apparatus>

Figure 1B:
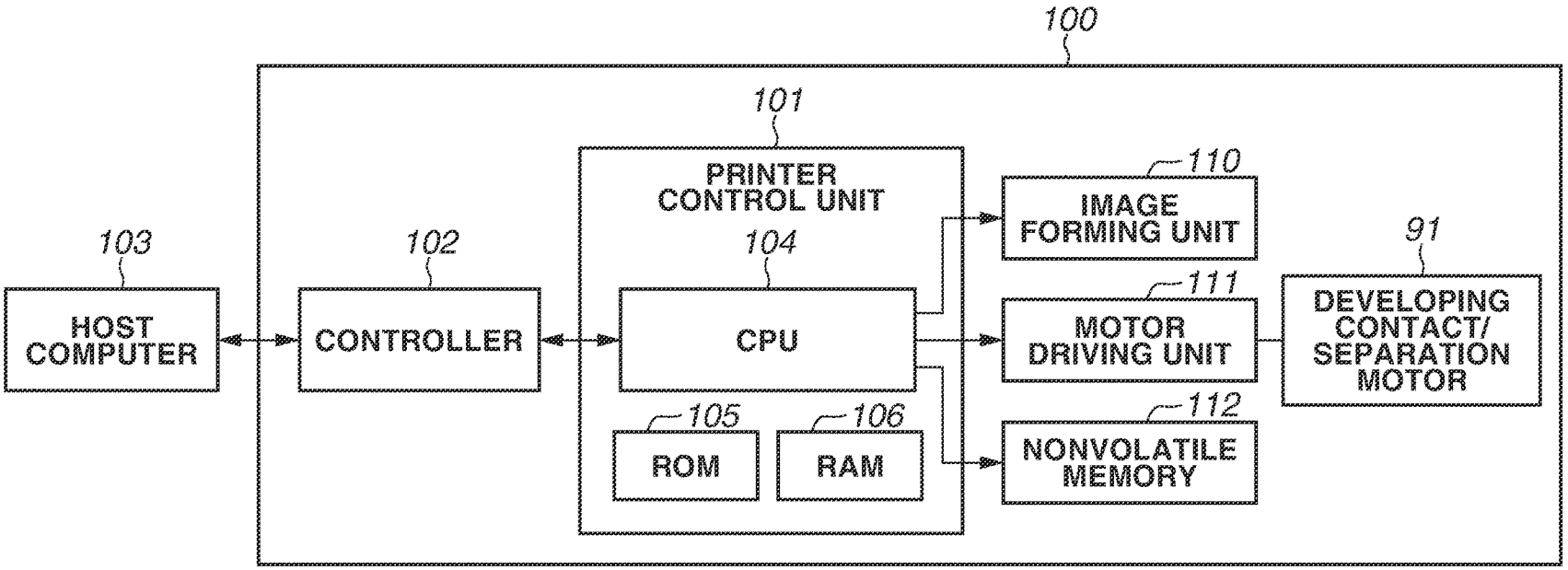

FIG. 1B is a control block diagram illustrating a system configuration of the printer 100 illustrated in FIG. 1A. A printer control unit 101 includes a central processing unit (CPU) 104, a read-only memory (ROM) 105, and a random access memory (RAM) 106. The CPU 104 serving as a control unit controls an image forming operation of the printer 100 in a centralized manner based on a control program stored in the ROM 105. The CPU 104 includes a timer (not illustrated) for measuring time. The RAM 106 is used as a main memory and a work area of the CPU 104. The CPU 104 is connected with an image forming unit 110 which includes the process stations 5 and the developing voltage power supply, and a motor driving unit 111 which drives a developing contact/separation motor 91 serving as a driving unit. The CPU 104 controls the image forming unit 110 and the motor driving unit 111 to perform image formation. The developing contact/separation motor 91 is a stepping motor. The CPU 104 is connected with a nonvolatile memory 112, and stores control information to be stored even after power-off into the nonvolatile memory 112.

A controller 102 is connected to the printer control unit 101. The controller 102 gives print instructions to the printer control unit 101 according to settings from a host computer 103 connected via a network or a printer cable. If the controller 102 receives image information and a print command from the host computer 103, the controller 102 analyzes and converts the received image information into bitmap data. During printing (during image formation), the controller 102 transmits the bitmap data to the printer control unit 101 in synchronization with a TOP signal transmitted from the printer control unit 101. The functions of the printer control unit 101 may be implemented by the CPU 104 executing various control programs. Part of or all the functions may be performed by a dedicated application specific integrated circuit (ASIC).

<Overview of Developing Contact/Separation Mechanism>

Figure 2A:
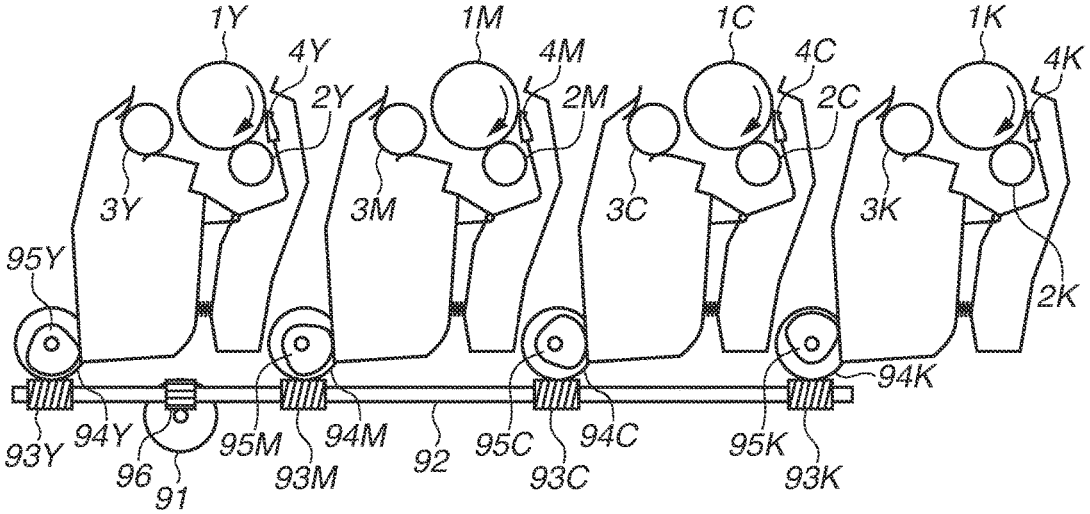
FIGS. 2A and 2B are configuration diagrams illustrating a developing contact/separation mechanism according to one or more aspects of the present disclosure.
Figure 2B:
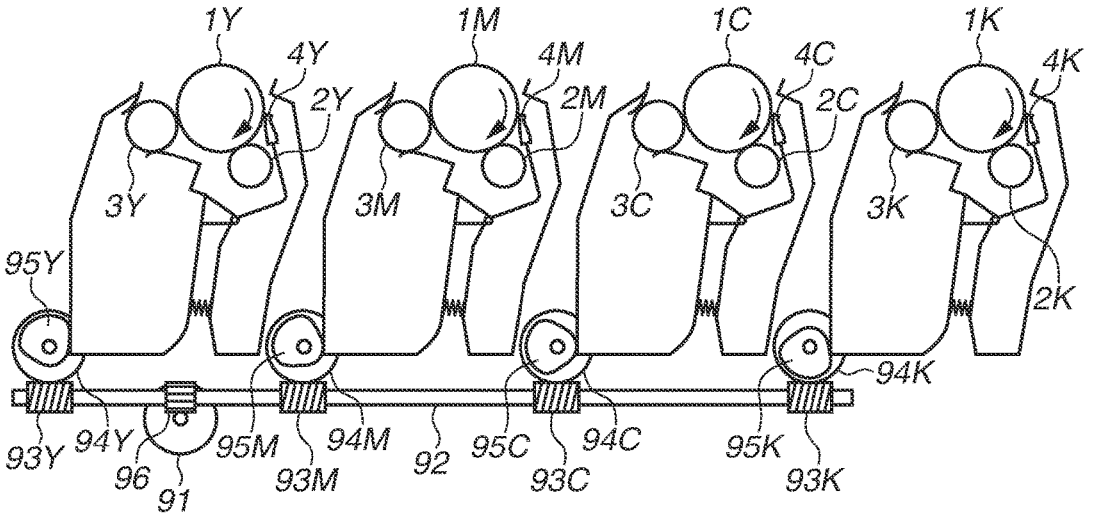

Next, a developing contact/separation mechanism serving as a contact/separation unit for switching the photosensitive drums 1 and the developing rollers 3 between a contact state and a separated state will be described with reference to FIGS. 2A and 2B. In FIGS. 2A and 2B, the developing contact/separation motor 91 (hereinafter, also referred to as motor 91) which drives the developing contact/separation mechanism for switching the contact and separation of the photosensitive drums 1 and the developing rollers 3 is connected to a driving switch shaft 92 via a worm pinion gear 96. Warm gears 93 for driving cam gears 94 of the process stations 5 of the respective colors are arranged on the driving switch shaft 92. As the driving switch shaft 92 rotates, cams 95 of the cam gears 94 change in phase, and the pressing forces of the cams 95 for pressing the side surfaces of the process stations 5 change. This can switch the photosensitive drums 1 and the developing rollers 3 of the respective process stations 5 between the contact state and the separated state. FIG. 2A illustrates a home state (also referred to as a home position) in which the developing rollers 3 of all the colors Y, M, C, and K are separated from the photosensitive drums 1. FIG. 2B illustrates a full contact state (also referred to as a full contact position) in which the developing rollers 3 of all the colors Y, M, C, and K are in contact with the photosensitive drums 1. If the motor is driven from the home state of FIG. 2A, the photosensitive drums 1 and the developing rollers 3 of the process stations 5 sequentially come into contact in order of the process stations 5 of yellow (Y), magenta (M), cyan (C), and black (K). The photosensitive drums 1 and the developing rollers 3 of the processing stations 5 thus transition to the full contact state.

<Control Timing of Developing Contact and Separation Controls>

Figure 3:
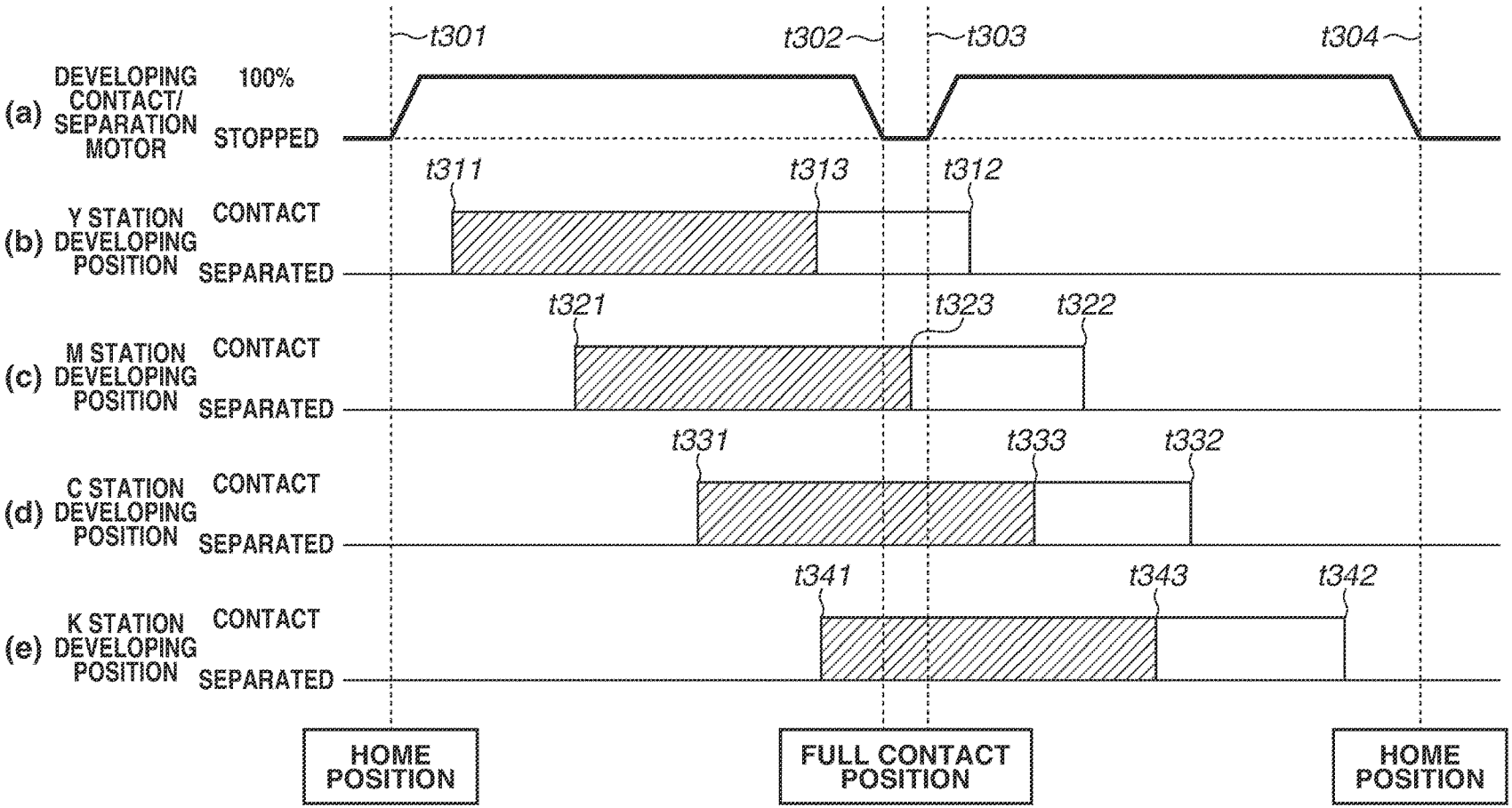
FIG. 3 is a timing chart of normal developing contact and separation controls according to one or more aspects of the present disclosure.

FIG. 3 is a timing chart illustrating driving of the motor 91 for operating the developing contact/separation mechanism, and contact timing and separation timing of the photosensitive drums 1 and the developing rollers 3 of the respective process stations 5 during image formation. FIG. 3 illustrates driving timing (a) of the motor 91 (in the diagram, developing contact/separation motor). In a state "stopped", the driving of the motor 91 is stopped. In a state "100%", the motor 91 is driven at normal rotation speed. Contact/separated states (in the diagram, developing positions) (b) to (e) of the process stations 5 illustrate the contact and separated states of the process stations 5Y, 5M, 5C, and 5K, respectively. In a state "contact", the photosensitive drum 1 and the developing roller 3 of each process station 5 are in contact with each other. In a state "separated", the photosensitive drum 1 and the developing roller 3 of each process station 5 are separated. The horizontal axis indicates time, including times (timing) t301 to t304, t311 to t313, t321 to t323, t331 to t333, and t341 to t343. In the following description, the process station 5Y, the process station 5M, the process station 5C, and the process station 5K may be referred to as a Y station, an M station, a C station, and a K station, respectively.

At time t301, the developing rollers 3 of all the colors Y, M, C, and K are in the home position where the developing rollers 3 are separated from the photosensitive drums 1. If the motor 91 is driven at time t301, the driving switch shaft 92 rotates, and the cams 95 of the cam gears 94 of the process stations 5 change in phase. At time t311, the rotation angle of the cam 95Y of the Y station reaches a predetermined angle, and the developing roller 3Y and the photosensitive drum 1Y of the Y station come into contact. An electrostatic latent image based on image data output from the controller 102 is formed on the contacted photosensitive drum 1Y of the Y station, and development processing is started after the developing roller 3Y and the photosensitive drum 1Y come into contact.

The motor 91 continues to rotate further. At time t321, the cam 95M of the M station reaches the next predetermined angle, and the developing roller 3M and the photosensitive drum 1M of the M station come into contact. Subsequently, the developing rollers 3 and the photosensitive drums 1 of the C station and the K station come into contact at times t331 and t341, respectively. The time intervals (time widths) between times t311 and t321, times t321 and t331, and times t331 and t341 are the same. The developing rollers 3 and the photosensitive drums 1 of the respective process stations 5 come into contact with each other with predetermined time differences.

At time t302, the developing rollers 3 and the photosensitive drums 1 of all the process stations 5 enter the contact state, i.e., the full contact position, and the driving of the motor 91 is once stopped. The state between times t302 and t303 in which the developing rollers 3 and the photosensitive drums 1 of the process stations 5 are in contact with each other is referred to as the full contact position. While the printer 100 performs a print job, the driving of the motor 91 is stopped to maintain such a state, i.e., the state in which the developing rollers 3 and the photosensitive drums 1 of all the process stations 5 are in contact with each other. The timing chart illustrated in FIG. 3 is a timing chart for a print job of printing a single sheet P.

At time t303, the motor 91 is driven again. The driving switch shaft 92 rotates, and the cams 95 of the cam gears 94 of the process stations 5 change in phase. At time t312, the rotation angle of the cam 95Y of the Y station reaches a predetermined angle, and the developing roller 3Y and the photosensitive drum 1Y of the Y station are separated. Subsequently, the developing rollers 3 and the photosensitive drums 1 of the M, C, and K stations are sequentially separated at time t322, t332, and t342, respectively. The time intervals between times t312 and t322 and times t322 and t332 are the same.

The K station is a station including black toner. Monochrome printing is performed with only the photosensitive drum 1K and the developing roller 3K of the K station in contact with each other. For that purpose, a situation in which only the photosensitive drum 1K and the developing roller 3K of the K station are securely in contact and the photosensitive drums 1 and the developing rollers 3 of the other Y, M, C stations are separated needs to be created. The time width between the separation timing t332 of the C station and the separation timing t342 of the K station is therefore designed to be greater than the time widths between the separations of the other stations, i.e., between times t312 and t322 and times t322 and t332. This increases the time in which the photosensitive drum 1K and the developing roller 3K of the K station are in contact, i.e., the time width between times t341 to t342, compared to those of the Y, M, and C stations. On the other hand, the times in which the photosensitive drums 1 and the developing rollers 3 of the Y, M, and C stations are in contact, i.e., the time widths between times t311 and t312, times t321 and t322, and times t331 and t332 are the same. In such a manner, the contact and separation of the photosensitive drums 1 and the developing rollers 3 can be executed according to the development processing of the respective process stations 5. The photosensitive drums 1 and the developing rollers 3 can be brought into contact only in the time widths in which the photosensitive drums 1 and the developing rollers 3 are used in the development processing.

<Issues>

In FIG. 3, time t311 to t312, time t321 to t322, time t331 to t332, and time t341 to t342 represent the times in which the photosensitive drums 1 and the developing rollers 3 of the respective process stations 5 are in contact when a single sheet is printed. Such time widths are predetermined ones corresponding to a sheet having a maximum printable size of the printer 100, regardless of the size of the sheet to be printed. Within such periods, the process stations 5 perform the development processing of making toner adhere to electrostatic latent images on the photosensitive drums 1 to form toner image.

The shaded areas in FIG. 3 represent development processing timing when the printer 100 prints, for example, a letter sheet having a small length in the conveyance direction. More specifically, in FIG. 3, the Y, M, C, and K stations perform the development processing on the letter sheet in time t311 to t313, time t321 to t323, time t331 to t333, and time t341 to t343, respectively. As illustrated in FIG. 3, in printing the letter sheet, the development processing of the Y station is completed before time t302 when the transition to the full contact position occurs. The time between time t313 when the development processing of the Y station is completed and time t312 when the photosensitive drum 1Y is separated from the developing roller 3Y is an unnecessary contact time not used for the development processing. This causes an issue that the photosensitive drum 1Y and the developing roller 3Y wear as much as the time width between times t313 and t312, and the life of the members expires earlier. Some print jobs use a sheet having a sheet length longer than that of the letter sheet. Some print jobs perform printing of a plurality of pages, including two-sided printing. In such print jobs, the development processing continues even after the transition to the full contact position, and there occurs no unnecessary contact time of the photosensitive drum 1Y and the developing roller 3Y.

According to Japanese Patent Application Laid-Open No. 2012-022142, to reduce unnecessary contact times, processing for driving the motor 91 at a rotation speed (driving speed) higher than a normal rotation speed (100%) to advance the separation timing of the photosensitive drums 1 and the developing rollers 3 is started at time t303. However, since the separation timing of the process stations 5 is not uniform, the contact times of the photosensitive drums 1 and the developing rollers 3 vary from one process station 5 to another. This results in an issue that the members have different life expiration periods from one process station 5 to another, and the times to replace the Y, M, and C process stations 5Y, 5M, and 5C do not coincide.

<Control of Contact/Separation Timing by Increasing Motor Driving Speed>

Figure 4A:
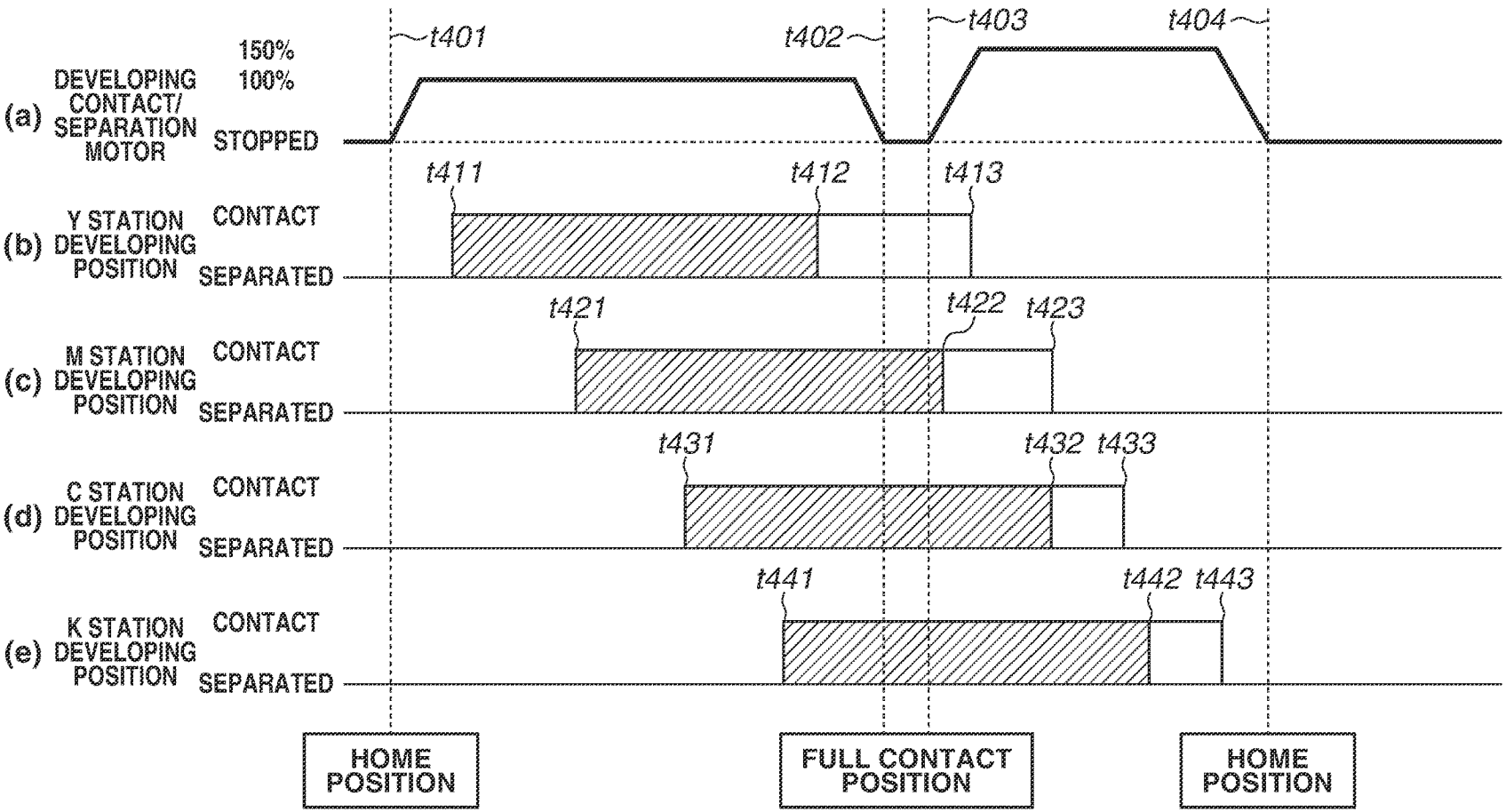
FIGS. 4A and 4B are timing charts of developing contact and separation controls according to one or more aspects of the present disclosure.
Figure 4B:
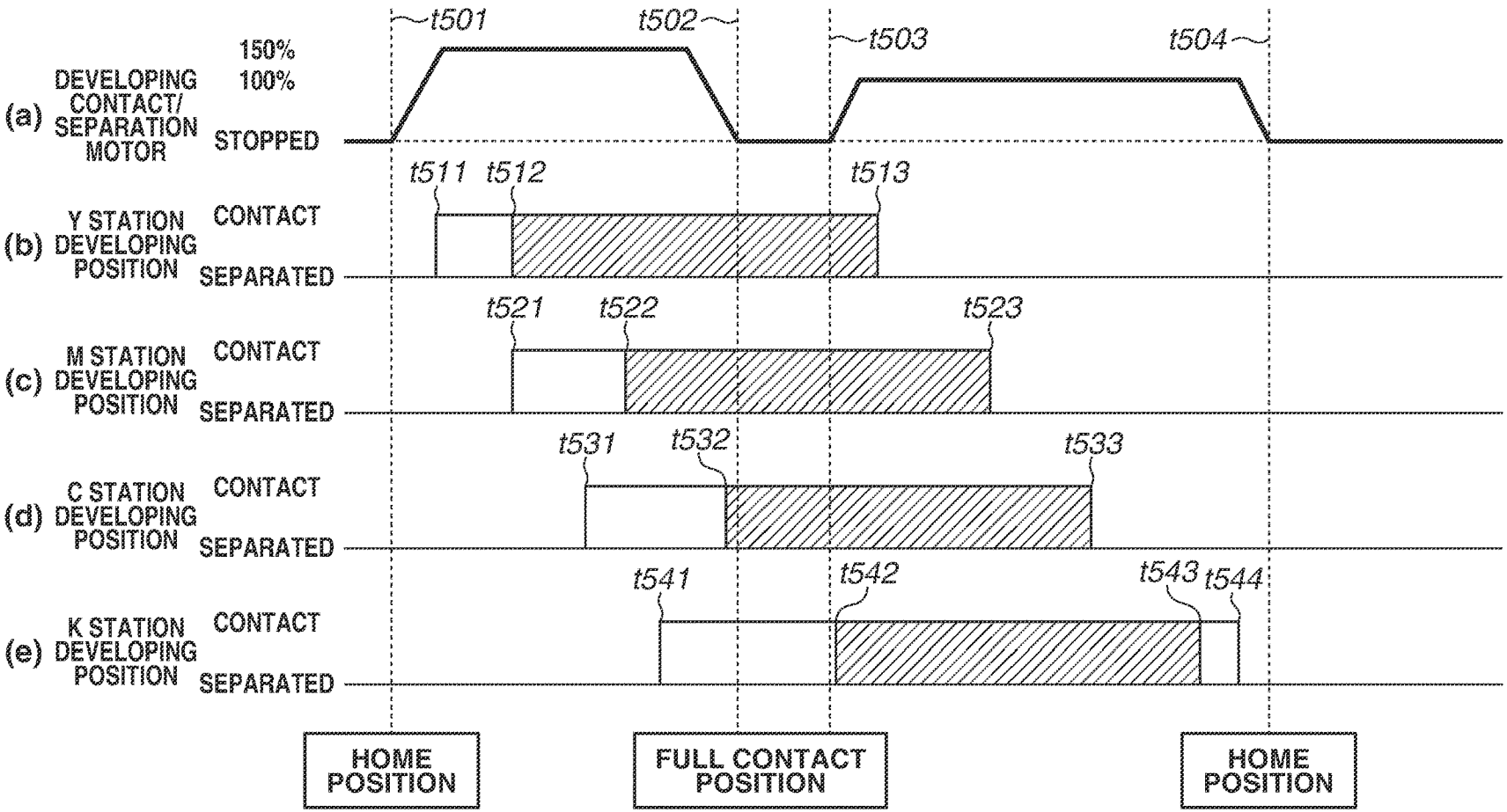

The printer control unit 101 of the image forming apparatus according to the present exemplary embodiment has two reduced sequences in which the motor 91 is driven at a rotation speed faster than the normal rotation speed. One is a reduced separation sequence for reducing a shift time from a state in which the photosensitive drums 1 and the developing rollers 3 are in contact to a state in which the photosensitive drums 1 and the developing rollers 3 are separated. The other is a reduced contact sequence for reducing a shift time from a state in which the photosensitive drums 1 and the developing rollers 3 are separated to a state in which the photosensitive drums 1 and the developing rollers 3 are in contact. FIG. 4A is a timing chart for describing the reduced separation sequence. FIG. 4B is a timing chart for describing the reduced contact sequence. FIGS. 4A and 4B both are timing charts when one-sided printing of a letter sheet is performed.

FIG. 4A illustrates driving timing (a) of the motor 91 (in the diagram, developing contact/separation motor). In a state "stopped", the driving of the motor 91 is stopped. In a state "100%", the motor 91 is driven at the normal rotation speed. In a state "150%", the motor 91 is driven at a rotation speed 1.5 times the normal rotation speed. Contact/separated states (b) to (e) illustrate those of the Y, M, C, and K stations, respectively. The horizontal axis indicates time, including times (timing) t401 to t404, t411 to t413, t421 to t423, t431 to t433, and t441 to t443.

In FIG. 4A, the timing chart from the home position (time t401) to the full contact position (time t402) is similar to that of FIG. 3. A description thereof will be omitted. At time t403, the motor 91 is driven at a speed 1.5 times (150%) the normal rotation speed. The driving switch shaft 92 rotates, and the cams 95 of the cam gears 94 of the process stations 5 change in phase. At time t413, the rotation angle of the cam 95Y of the Y station reaches a predetermined angle, and the developing roller 3Y and the photosensitive drum 1Y of the Y station are separated. The driving of the motor 91 is further continued. At time t423, the rotation angle of the cam 95M reaches the next predetermined angle, and the developing roller 3M and the photosensitive drum 1M of the M station are separated. Subsequently, the developing rollers 3 and the photosensitive drums 1 of the C and K stations are similarly separated at time t433 and t443, respectively, with a predetermined time difference.

The motor 91 is thus driven at a speed 1.5 times faster than the normal rotation speed, whereby unnecessary times (hereinafter, referred to as idle running times) (the outlined contact time zones other than the shaded areas in the states (b) to (d) of FIG. 4A) not used in the development processing are reduced, compared to the normal time (FIG. 3). The reduction effect of the idle running times differs from one process station 5 to another. The more downstream a station 5 is arranged in the rotation direction of the intermediate transfer belt 8, the more the idle running time is reduced. The increase in the speed of the motor 91 is determined by the torque of the configuration of the developing contact/separation mechanism.

Next, FIG. 4B illustrating the timing chart of the reduced contact sequence for reducing the shift time from the state in which the photosensitive drums 1 and the developing rollers 3 are separated to the state in which the photosensitive drums 1 and the developing rollers 3 are in contact will be described. A configuration of FIG. 4B is similar to that of FIG. 4A. A description thereof will be omitted. The horizontal axis in FIG. 4B indicates time, including times (timing) t501 to t504, t511 to t513, t521 to t523, t531 to t533, and t541 to t544.

At time t501, the developing rollers 3 of all the colors Y, M, C, and K are in the home position in which the developing rollers 3 are separated from the photosensitive drums 1. At time t501, the motor 91 is driven at a speed 1.5 times (150%) the normal rotation speed. The driving switch shaft 92 rotates, and the cams 95 of the cam gears 94 of the process stations 5 change in phase. At time t511, the rotation angle of the cam 95Y of the Y station reaches a predetermined angle, and the developing roller 3Y and the photosensitive drum 1Y of the Y station come into contact. The driving of the motor 91 is further continued. At time t521, the rotation angle of the cam 95M reaches the next predetermined angle, and the developing roller 3M and the photosensitive drum 1M of the M station come into contact. Subsequently, the developing rollers 3 and the photosensitive drums 1 of the C and K stations similarly come into contact at times t531 and t541 with a predetermined time difference.

The development processing of the photosensitive drums 1 is performed at predetermined timing regardless of the rotation speed of the motor 91. More specifically, in FIG. 4A, the motor 91 is driven at the normal rotation speed (100%), and the development processing (in the diagram, the shaded areas) is performed at timing when the photosensitive drums 1 and the developing rollers 3 come into contact. Meanwhile, in FIG. 4B, the motor 91 is driven at a speed 1.5 time (150%) the normal rotation speed. The timing to start the development processing therefore lags behind the timing when the photosensitive drums 1 and the developing rollers 3 come into contact.

Since the motor 91 is thus driven at a speed 1.5 times faster than the normal rotation speed, the transition to the full contact position can be completed before the completion of the development processing of the Y station (t502<t513). A normal separation operation of the developing rollers 3 and the photosensitive drums 1, in which the motor 91 is driven at a 100% speed, can thus be executed according to the development completion timing (time t513) of the Y station. In FIG. 4B, time t543 to t544 of the K station is provided to secure a time in which only the developing roller 3K and the photosensitive drum 1K of the K station are in contact. By the developing contact and separation controls described above, the unnecessary idle running times (outlined time zones in the states (b) to (d) of FIG. 4B) not used in the development processing are reduced, compared to the normal time (FIG. 3). The reduction effect of the idle running times differs from one process station 5 to another. The more upstream a station 5 is arranged in the rotation direction of the intermediate transfer belt 8, the more the idle running time is reduced.

In the present exemplary embodiment, the idle running time (time t412 to t413) of the Y station in FIG. 4A and the idle running time (time t531 to t532) of the C station in FIG. 4B are designed to have almost the same time widths. The idle running time (time t422 to t423) of the M station in FIG. 4A and the idle running time (time t521 to t522) of the M station in FIG. 4B are designed to have almost the same time widths. The idle running time (time t432 to t433) of the C station in FIG. 4A and the idle running time (time t511 to t512) of the Y station in FIG. 4B are also designed to have almost the same time widths. In other words, in the present exemplary embodiment, the sum of the idle running times of the Y, M, and C stations in the reduced separation sequence of FIG. 4A and the sum of the idle running times in the reduced contact sequence of FIG. 4B are configured to be almost the same.

As described above, the separation timing of the K station in normal time is different from that of the other stations. In the present exemplary embodiment, the contact times of the other stations except the K station are designed to have almost the same time widths. If the separation timing of the K station in normal time is configured to be at almost the same time intervals as those of the other stations are, the contact times of all the stations may be configured to be almost the same.

<Contact and Separation Control Sequences of Photosensitive Drums and Developing Rollers>

As described above, if unnecessary contact occurs between the photosensitive drums 1 and the developing rollers 3, the printer control unit 101 executes either of the reduced separation and contact sequences. The printer control unit 101 according to the present exemplary embodiment alternately executes the reduced separation sequence illustrated in FIG. 4A and the reduced contact sequence illustrated in FIG. 4B. In such a manner, the printer control unit 101 reduces unevenness in the contact times of the developing rollers 3 and the photosensitive drums 1 of the Y, M, and C stations.

Figure 5:
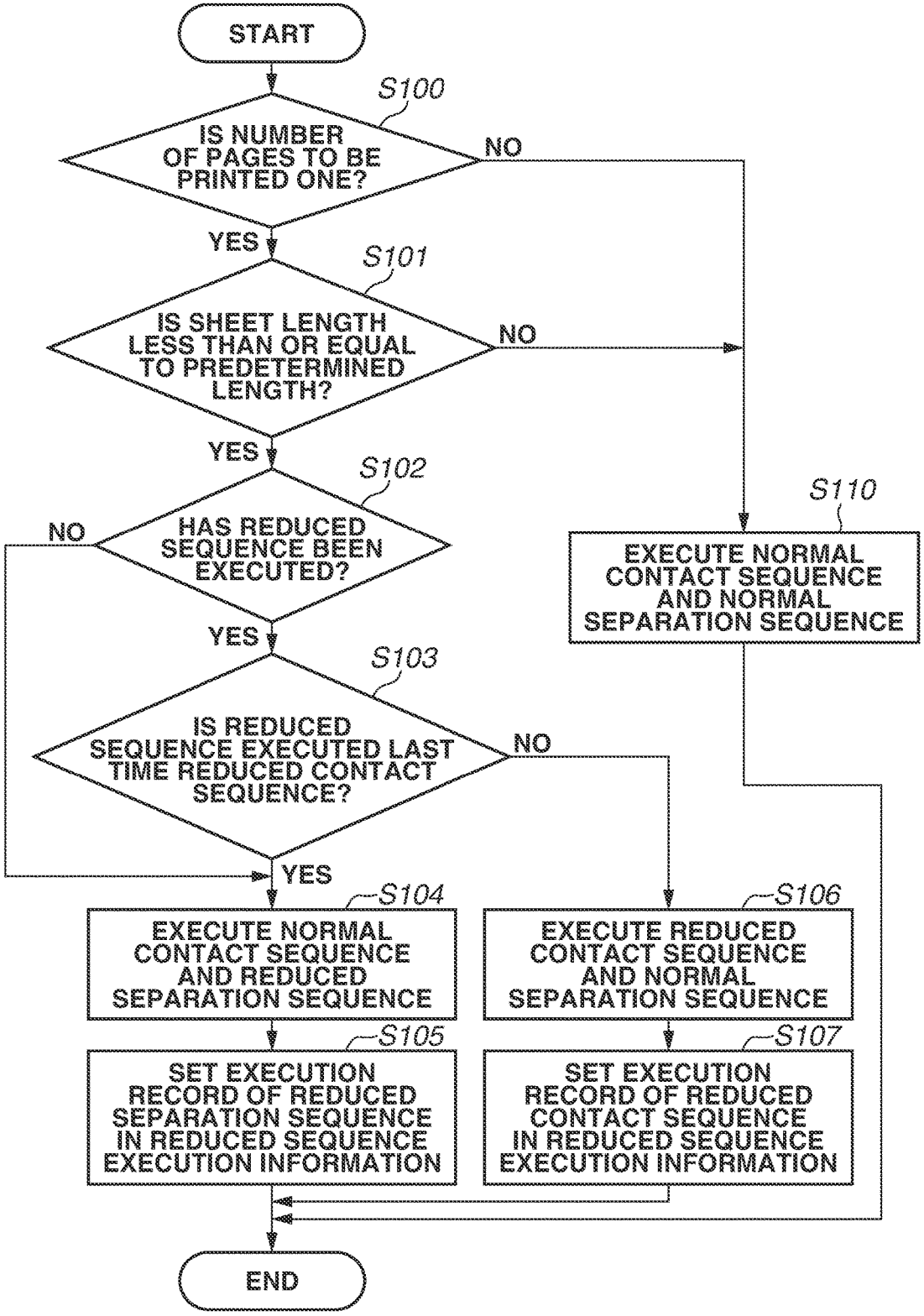
FIG. 5 is a flowchart illustrating developing contact and separation control sequences according to one or more aspects of the present disclosure.

FIG. 5 is a flowchart illustrating a control sequence for controlling the contact and separated states of the photosensitive drums 1 and the developing roller 3 of the printer 100 according to the present exemplary embodiment. The processing illustrated in FIG. 5 is started upon execution of a print job, and is performed by the CPU 104 of the printer control unit 101. The number of pages to be printed and a sheet size of the print job are set in a print command transmitted from the controller 102 to the printer control unit 101. The nonvolatile memory 112 stores reduced sequence execution information in which an execution record is set when the reduced separation sequence or the reduced contact sequence is executed.

In step S100, the CPU 104 determines based on the information set in the print command received from the controller 102 whether the number of sheets to be printed by the print job is one. If the CPU 104 determines that the number of pages to be printed is one (YES in step S100), the processing proceeds to step S101. If the CPU 104 determines that the number of pages to be printed is not one (two or more) (NO in step S100), the processing proceeds to step S110. In step S101, the CPU 104 determines based on the information set in the print command received from the controller 102 whether the sheet length of the sheet used in the print job is less than or equal to a predetermined length. Suppose that the predetermined length is 215.9 mm. If the CPU 104 determines that the sheet length is less than or equal to the predetermined length (215.9 mm) (YES in step S101), the processing proceeds to step S102. If the CPU 104 determines that the sheet length is greater than the predetermined length (NO in step S101), the processing proceeds to step S110. The sheet length of 215.9 mm is the length of a letter size sheet of the printer 100 of the present exemplary embodiment in the conveyance direction. The printer 100 according to the present exemplary embodiment causes unnecessary contact between the photosensitive drums 1 and the developing rollers 3 if the print job is to print a single page of the sheet having such a sheet length. Unnecessary contact times can also occur from a sheet having a sheet length somewhat longer than that of the letter size. In the present exemplary embodiment, for simplification of control, the reduce sequences are applied to sheets having sheet lengths less than or equal to that of the letter size which is the sheet size for standard use.

In step S102, the CPU 104 refers to the reduced sequence execution information stored in the nonvolatile memory 112 and determines whether either one of the reduced separation and contact sequences is executed (whether a reduced sequence has been executed). If the CPU 104 determines that neither of the reduced sequences is executed (NO in step S102), the processing proceeds to step S104. If the CPU 104 determines that the reduced separation sequence or the reduced contact sequence is executed last time (YES in step S102), the processing proceeds to step S103. In step S103, to select the reduced sequence to be executed this time, the CPU 104 refers to the reduced sequence execution information and determines whether the reduced sequence executed last time is the reduced contact sequence. If the CPU 104 determines that the reduced contact sequence is executed last time (YES in step S103), the processing proceeds to step S104. If the CPU 104 determines that the reduced contact sequence is not executed last time (the reduced separation sequence is executed) (NO in step S103), the processing proceeds to step S106.

In step S104, the CPU 104 executes a contact sequence in normal time (normal contact sequence), which is a first contact control, when bringing the photosensitive drums 1 and the developing rollers 3 into contact. When separating the photosensitive drums 1 and the developing rollers 3, the CPU 104 executes the reduced separation sequence which is a second separation control (see FIG. 4A). In step S105, the CPU 104 sets the execution record of the reduced separation sequence in the reduced sequence execution information. The processing ends.

In step S106, the CPU 104 executes the reduced contact sequence, which is a second contact control, when bringing the photosensitive drums 1 and the developing rollers 3 into contact. When separating the photosensitive drums 1 and the developing rollers 3, the CPU 104 executes a separation sequence in normal time (normal separation sequence) which is a first separation control (see FIG. 4B). In step S107, the CPU 104 sets the execution record of the reduced contact sequence in the reduced sequence execution information. The processing ends. In step S110, the CPU 104 executes the normal contact sequence and the normal separation sequence in which the motor 91 is driven at the normal speed (see FIG. 3). The processing ends.

According to the present exemplary embodiment, the contact times of the photosensitive drums 1 and the developing rollers 3 of the Y, M, and C stations can be made almost the same. This can reduce the unnecessary contact times of the photosensitive drums 1 and the developing rollers 3. As a result, the amounts of wear of the photosensitive drums 1 and the developing rollers 3 can be reduced and made almost the same, whereby the times to replace the Y, M, and C stations can be made to coincide.

In the present exemplary embodiment, the reduced contact sequence and the reduced separation sequence are described to be alternately executed. However, for example, the reduced contact sequence may be executed a plurality of times before the reduced separation sequence is executed a plurality of times. For example, suppose that the contact times of the photosensitive drums 1 and the developing rollers 3 during development in performing one-sided printing on a sheet is 1000 ms (milliseconds), and a difference between the contact times of the Y and C stations in the reduced contact sequence or the reduced separation sequence is 100 ms. In such a case, the execution of the reduced contact sequence and the reduced separation sequence is switched at every ten times or less. In such a manner, the total of the differences (=100 ms) between the contact times of the Y and C stations can be controlled to be less than or equal to a predetermined time which is the contact time (=1000 ms) corresponding to when a page of sheet is printed. More specifically, suppose that Td is a difference between the contact times of the photosensitive drums 1 and the developing rollers 3 of the stations except the K station when a reduced sequence is executed. Tp is an upper limit value of the difference between the contact times of the photosensitive drums 1 and the developing rollers 3 of the plurality of stations. For example, suppose that Td is 100 ms, and Tp is 1000 ms. A threshold (predetermined number of times) of the number of times of execution up to which the same reduced sequence can be consecutively executed can be calculated by Tp/Td (=(1000 ms/100 ms)=10). The threshold of the number of times of execution is a maximum integer value less than or equal to (Tp/Td).

In the present exemplary embodiment, the driving speed of the motor 91 in the reduced separation sequence is 1.5 times (150%) the normal driving speed, i.e., constant. After time t433 (see FIG. 4A) which is the separation timing of the C station, processing for further increasing the driving speed may be performed. This can reduce the contact time of the photosensitive drum 1 and the developing roller 3 of the K station. In the present exemplary embodiment, the motor 91 is once stopped at the full contact position. However, the separation sequence may be executed without stopping the motor 91. This can further reduce the contact time. In the reduced contact sequence for transition from the home position to the full contact position, the speed of the motor 91 may be further increased to reduce the contact times. Similarly, in the reduced separation sequence, control for increasing the speed for a certain time past the full contact position may be performed to reduce the contact times.

The driving speeds of the motor 91 in the reduced contact sequence and the reduced separation sequence are almost the same. If accumulation of unnecessary contact times in each station is sufficiently small, the driving speeds may be somewhat different. Various modifications may be made to the foregoing exemplary embodiment based on the gist of the present disclosure, and such modifications are not excluded from the scope of the present disclosure. For example, various changes may be made to the types and rates of the process speeds of the image forming apparatus.

As described above, according to the present exemplary embodiment, the unnecessary contact times of the photosensitive drums and the developing rollers of the image forming units can be reduced, and unevenness in the contact times of the photosensitive drums and the developing rollers of the image forming unit can be reduced.

In the first exemplary embodiment, the control for reducing the contact times of the photosensitive drums and the developing rollers in performing one-sided printing on a sheet having a predetermined sheet size or smaller is described. In a second exemplary embodiment, control for reducing the contact times of the photosensitive drums and the developing rollers in performing two-sided printing for continuously forming images on the front and back of a sheet having a predetermined sheet size or smaller will be described. A configuration of the image forming apparatus according the present exemplary embodiment and a configuration of the control unit are similar to those in the first exemplary embodiment, and will be described by using the same reference numerals as in the first exemplary embodiment. A description thereof will be omitted here.

<Contact and Separation Control Sequences of Photosensitive Drums and Developing Rollers>

Figure 6:
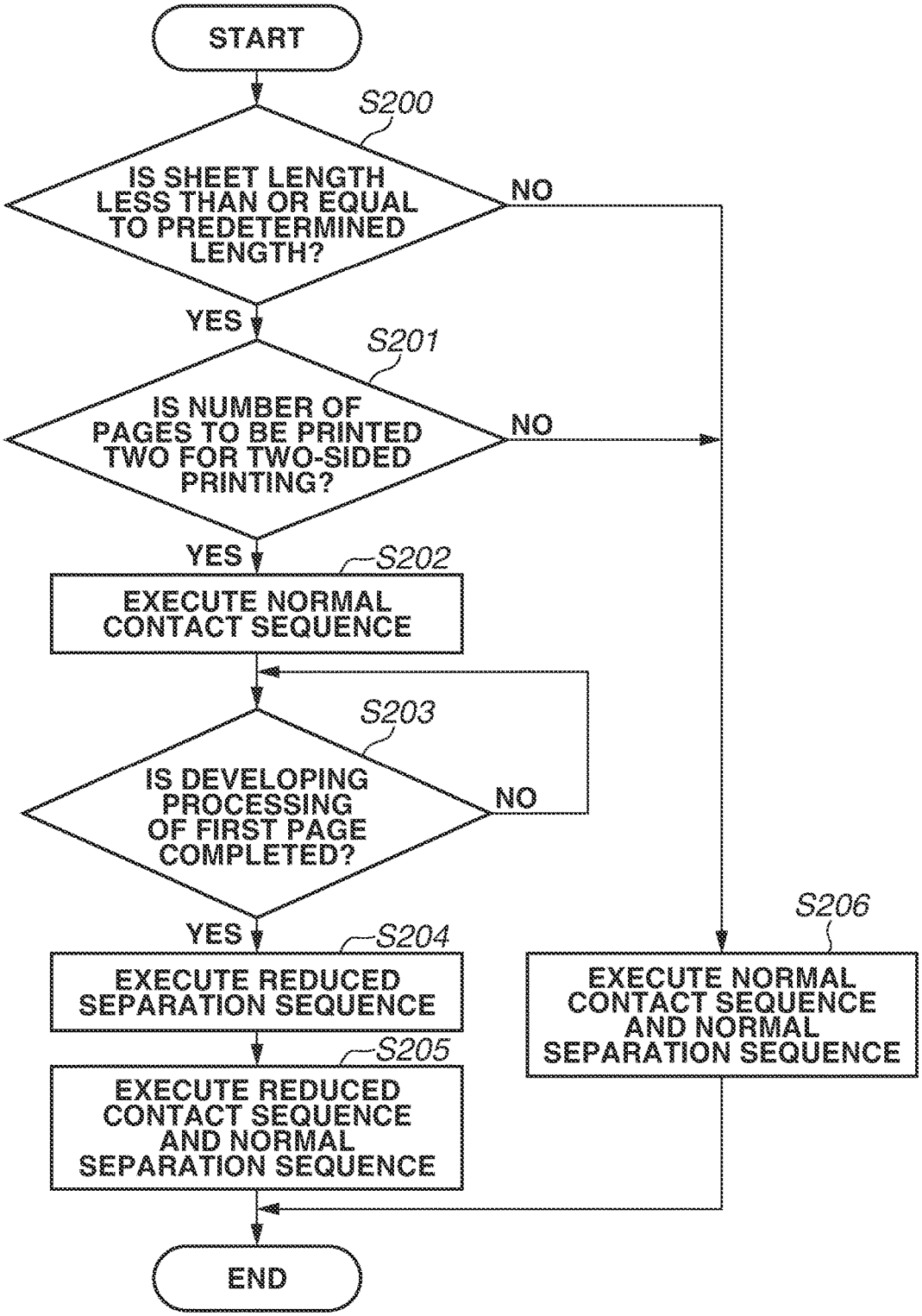
FIG. 6 is a flowchart illustrating developing contact and separation control sequences according to one or more aspects of the present disclosure.

FIG. 6 is a flowchart illustrating a control sequence for controlling the contact and separated states of the photosensitive drums 1 and the developing rollers 3 of the printer 100 according to the present exemplary embodiment. The processing illustrated in FIG. 6 is started upon execution of a print job, and performed by the CPU 104 of the printer control unit 101. The number of pages to be printed and the sheet size of the print job are set in a print command transmitted from the controller 102 to the printer control unit 101.

In step S200, the CPU 104 determines based on the information set in the print command received from the controller 102 whether the sheet length of the sheet used in the print job is less than or equal to a predetermined length. In the present exemplary embodiment, similar to the first exemplary embodiment, the predetermined sheet length is 215.9 mm which is the sheet length of the letter size. If the CPU 104 determines that the sheet length is less than or equal to the predetermined sheet length (215.9 mm) (YES in step S200), the processing proceeds to step S201. If the CPU 104 determines that the sheet length is greater than the predetermined sheet length (215.9 mm) (NO in step S200), the processing proceeds to step S206. In step S201, the CPU 104 determines based on the information set in the print command received from the controller 102 whether the number of pages to be printed by the print job is two for two-sided printing. If the CPU 104 determines that the number of pages to be printed is two for two-sided printing (YES in step S201), the processing proceeds to step S202. If the CPU 104 determines that the number of pages to be printed is not two for two-sided printing (NO in step S201), the processing proceeds to step S206. In step S206, the CPU 104 forms images by executing the normal contact sequence and the normal separation sequence in which the motor 91 is driven at the normal speed. The processing ends. In step S206, unlike the process in step S204 to be described below, the CPU 104 does not perform processing for once separating the photosensitive drums 1 and the developing rollers 3 in the contact state from each other, between the first and second pages of the sheet.

In step S202, the CPU 104 executes the normal contact sequence when bringing the photosensitive drums 1 and the developing rollers 3 into contact. In step S203, the CPU 104 determines whether the photosensitive drums 1 and the developing rollers 3 of the process stations 5 are in contact and the development processing of the first page is completed. If the CPU 104 determines that the development processing is completed (YES in step S203), the processing proceeds to step S204. If the CPU 104 determines that the development processing is not completed (NO in step S203), the processing returns to step S203. In step S204, the CPU 104 executes the reduced separation sequence when separating the photosensitive drums 1 and the developing rollers 3. In the present exemplary embodiment, two-sided printing is performed. The sheet of which the first page is printed is then conveyed through the two-sided conveyance path. The time interval between the image formation of the first page (front of the sheet) and that of the second page (back of the sheet) needs to be greater than in normal time in which images are formed on two sheets by one-sided printing. The photosensitive drums 1 and the developing rollers 3 are therefore once separated between the image formation of the first page and that of the second page to reduce the unnecessary contact times of the photosensitive drums 1 and the developing rollers 3. In step S205, the CPU 104 executes the reduced contact sequence when bringing the photosensitive drums 1 and the developing rollers 3 into contact, and executes the normal separation sequence when separating the photosensitive drums 1 and the developing rollers 3. The processing ends.

<Control Timing of Developing Contact and Separation Controls>

Figure 7:
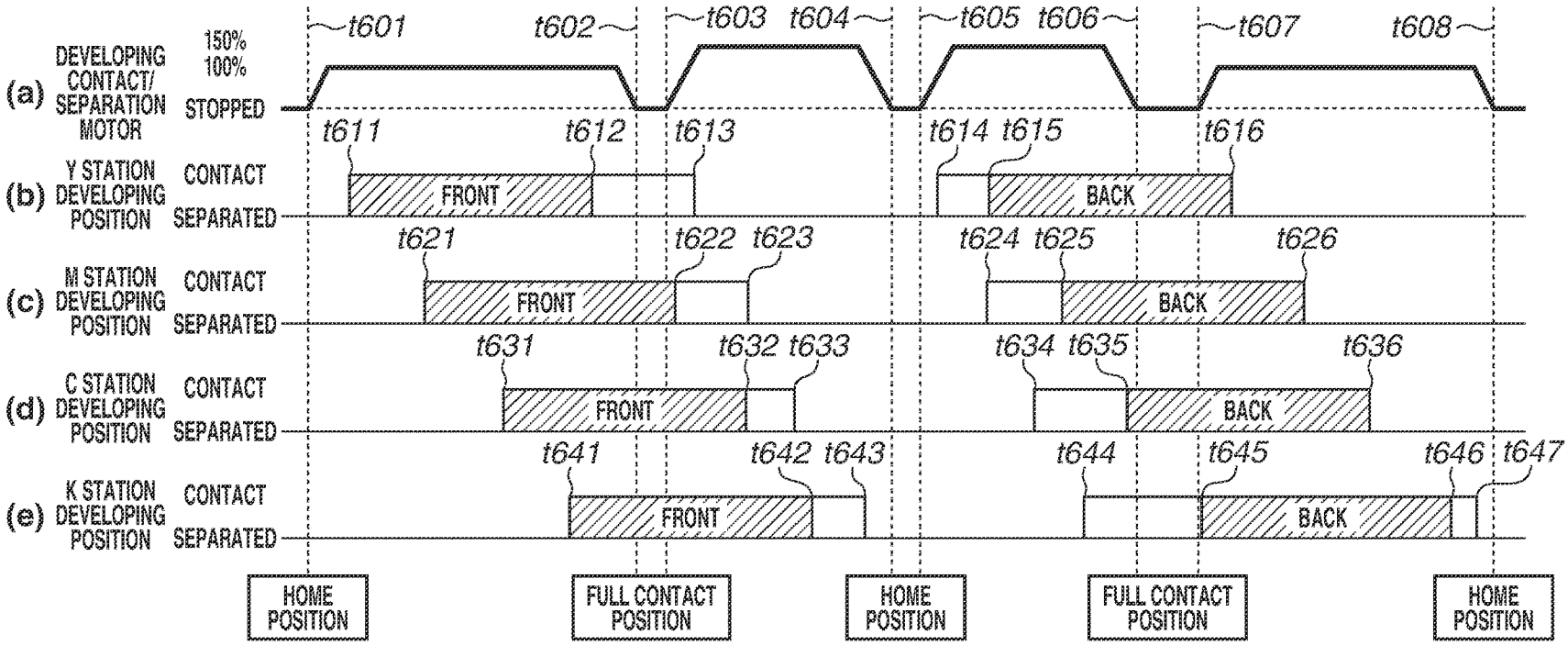
FIG. 7 is a timing chart of developing contact and separation controls according to one or more aspects of the present disclosure.

FIG. 7 is a timing chart for the case of two-sided printing described in FIG. 6 in which the front and back of a sheet having a predetermined sheet size or smaller are printed. FIG. 7 illustrates driving timing (a) of the motor 91 (in the diagram, developing contact/separation motor). In a state "stopped", the driving of the motor 91 is stopped. In a state "100%", the motor 91 is driven at the normal rotation speed (100%). In a state "150%", the motor 91 is driven at a rotation speed 1.5 times (150%) the normal rotation speed. Contact/separated states (b) to (e) are those of the Y, M, C, and K stations respectively. The horizontal axis indicates time, including times (timing) t601 to t608, t611 to t616, t621 to t626, t631 to t636, and t641 to t647.

In FIG. 7, the first page is printed (the front of the two-sided printing is printed) in time t601 to t604. The second page is printed (the back of the two-sided printing is printed) in time t605 to t608. Specifically, the processing of time t601 to t602 corresponds to the process in step S202 in FIG. 6 according to the foregoing first exemplary embodiment. The processing of time t603 to t604 corresponds to the process in step S204 in FIG. 6. As described above, to reduce the unnecessary contact times of the photosensitive drums 1 and the developing rollers 3, the photosensitive drums 1 and the developing rollers 3 of the process stations 5 are put in the separated state in time t604 to t605. The processing of time t605 to t608 corresponds to the process in step S205 in FIG. 6. The sum of the unnecessary contact times (outlined time zones in the contact/separated states (b) to (d) of FIG. 7) occurring in the process stations 5 for the image of the first page and that for the image of the second page are therefore almost the same.

According to the present exemplary embodiment, even in a two-sided print job on a sheet, the contact times of the photosensitive drums 1 and the developing rollers 3 of the Y, M, and C stations are made almost the same, and the unnecessary contact times of the photosensitive drums 1 and the developing rollers 3 can be reduced. The amounts of wear of the photosensitive drums 1 and the developing rollers 3 can thus be reduced and made almost the same, whereby the times to replace the Y, M, and C stations can be made to coincide.

In the present exemplary embodiment, the motor 91 is once stopped between the first and second pages, i.e., between times t604 and t605. The reason is that the time needed to convey the sheet through the two-sided conveyance path to the junction point 200 again is longer than the time needed for the reduced separation and contact sequences. In a configuration in which the time needed to convey the sheet through the two-sided conveyance path is short, the motor 91 may be controlled to not be stopped between times t604 and t605 for improved productivity. In the present exemplary embodiment, the two-sided print job on a single sheet is described. However, for example, the control of the present exemplary embodiment may be applied if a print job is such that a first sheet has a small sheet length and the interval between the first sheet and a second sheet is greater than normal image intervals.

As described above, according to the present exemplary embodiment, the unnecessary contact times of the photosensitive drums and the developing rollers of the image forming units can be reduced, and unevenness in the contact times of the photosensitive drums and the developing rollers of the image forming units can be reduced.

In the first and second exemplary embodiments, the motor 91 is described to be controlled at the same driving speed when the reduced contact sequence and the reduced separation sequence are performed. In a third exemplary embodiment, the motor 91 will be described to be controlled at different driving speeds during the reduced contact sequence and during the reduced separation sequence. More specifically, the torque of the developing contact/separation mechanism during separation may be so high that, in the reduce separation sequence, the motor 91 is unable to be driven at the driving speed 1.5 times the normal driving speed. In the present exemplary embodiment, control of the motor 91 in such a case will be described. Suppose that in the reduced contact sequence, the motor 91 can be controlled at the driving speed 1.5 times the normal driving speed. A configuration of the image forming apparatus according to the present exemplary embodiment and a configuration of the control unit are similar to those in the first exemplary embodiment, and will be described by using the same reference numerals as in the first exemplary embodiment. A description thereof will be omitted here.

<Control Timing of Developing Contact and Separation Controls>

Figure 8A:
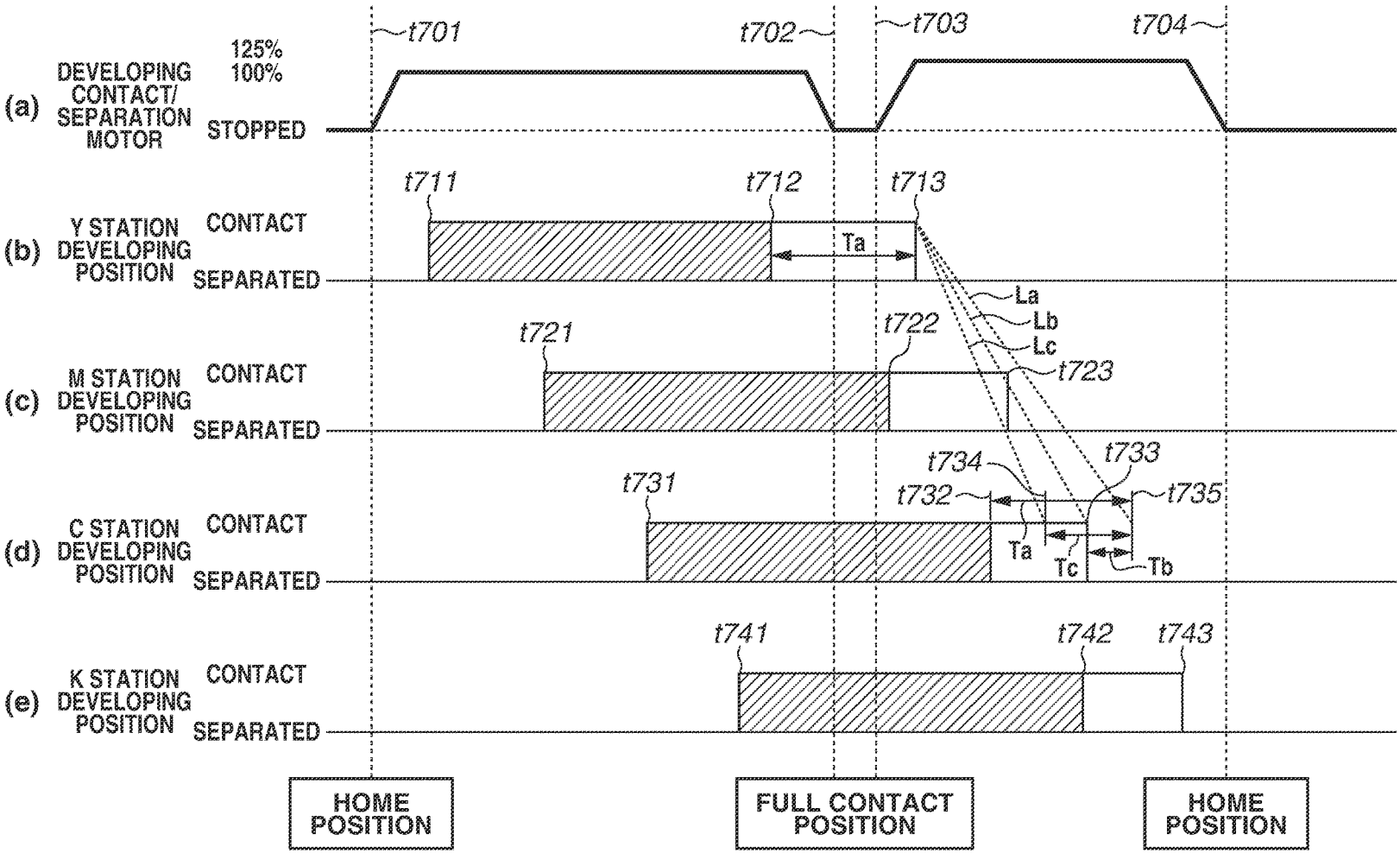
FIGS. 8A and 8B are timing charts of developing contact and separation controls according to one or more aspects of the present disclosure.
Figure 8B:
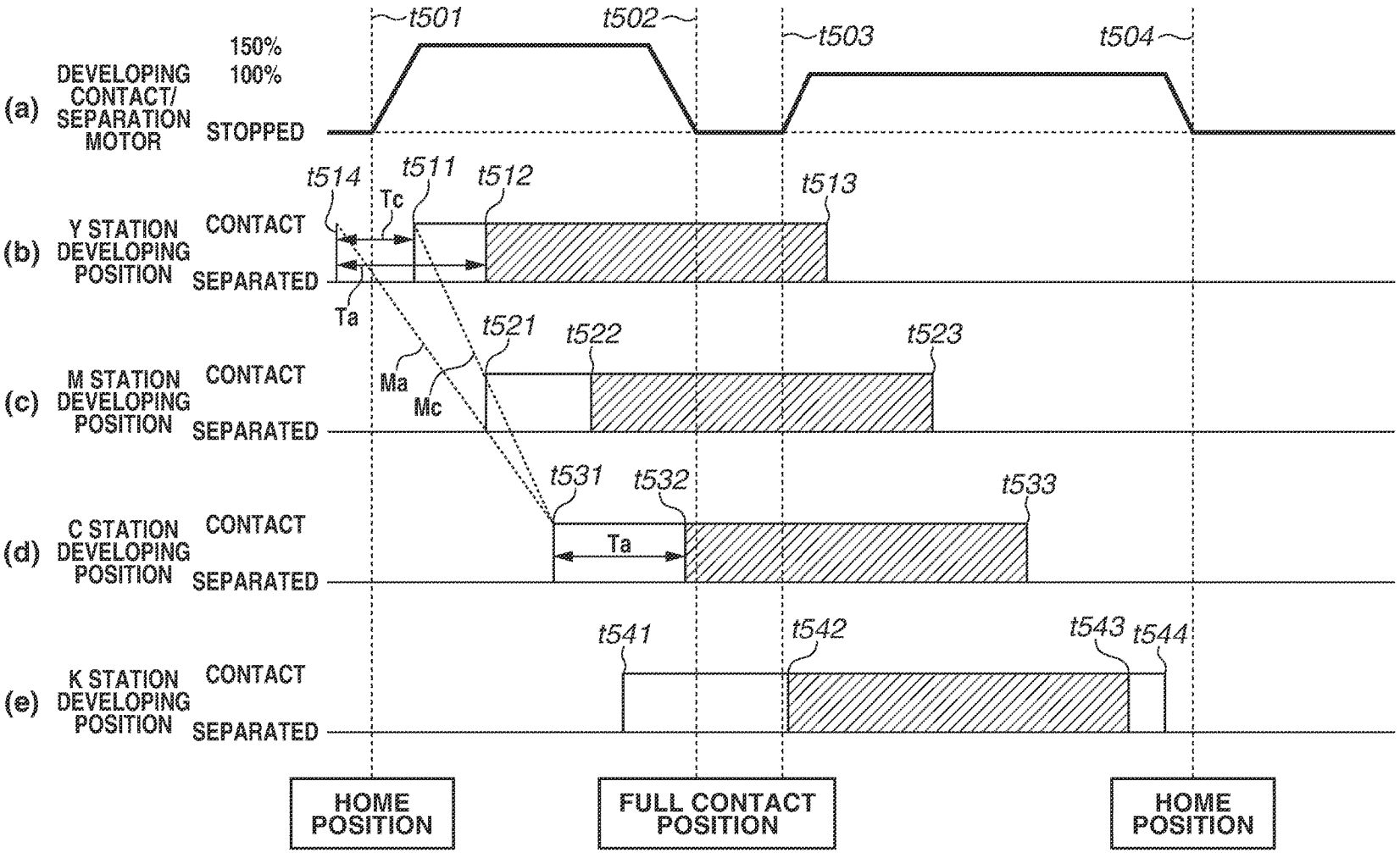

FIGS. 8A and 8B are timing charts when the driving speed of the motor 91 differs between the reduced contact sequence and the reduced separation sequence. FIG. 8A is a diagram for describing the reduced separation sequence. In the present exemplary embodiment, the torque of the developing contact/separation mechanism during separation is so high that the motor 91 is unable to be driven at a speed 1.5 times (150%) the normal driving speed. FIG. 8A illustrates a timing chart when the motor 91, during separation, is driven at a driving speed 1.25 times the normal driving speed. FIG. 8B is a diagram for describing the reduced contact sequence. FIG. 8B illustrates a timing chart when the motor 91, during contact, can be driven at the driving speed 1.5 times the normal driving speed.

FIG. 8A illustrates driving timing (a) of the motor 91 (in the diagram, developing contact/separation motor). In a state "stopped", the driving of the motor 91 is stopped. In a state "100%", the motor 91 is driven at the normal rotation speed. In a state "125%", the motor 91 is driven at a rotation speed 1.25 times the normal rotation speed. Contact/separated states (b) to (e) are those of the Y, M, C, and K stations, respectively. The horizontal axis indicates time, including times (timing) t701 to t704, t711 to t713, t721 to t723, t731 to t735, and t741 to t743.

In FIG. 8A, the timing chart from the home position (time t701) to the full contact position (time t702) is similar to that of FIG. 3 according to the first exemplary embodiment. A description thereof will be omitted here. At time t703, the motor 91 is driven at a speed 1.25 times (125%) the normal rotation speed. The driving switch shaft 92 rotates, and the cams 95 of the cam gears 94 of the process stations 5 change in phase. The driving of the motor 91 is further continued. At time t713, the rotation angle of the cam 95Y of the Y station reaches a predetermined angle, and the developing roller 3Y and the photosensitive drum 1Y of the Y station are separated. At time t723, the rotation angle of the cam 95M reaches the next predetermined angle, and the developing roller 3M and the photosensitive drum 1M of the M station are separated. Subsequently, the developing rollers 3 and the photosensitive drums 1 of the C and K stations are also separated at times t733 and t743 with predetermined time differences, respectively.

The timing chart illustrated in FIG. 8B is similar to that illustrated in FIG. 4B according to the first exemplary embodiment. The same reference numerals as those in FIG. 4B are assigned, and a description thereof will be omitted. In FIG. 8A, the unnecessary contact times of the photosensitive drums 1 and the developing rollers 3 of the M and C stations increase, compared to those in the reduced separation sequence illustrated in FIG. 4A in which the motor 91 is driven at a speed 1.5 times the normal rotation speed. The effect of the difference in the driving speed of the motor 91 on the Y station is small since the photosensitive drum 1Y and the developing roller 3Y are separated at timing immediately after the motor 91 is activated at time t703.

In FIG. 8A, a time width (time difference) between time t712 when the development processing of the Y station ends and time t713 when the photosensitive drum 1Y and the developing roller 3C are separated will be referred to as a time width Ta (see FIG. 8A, state (b)). Time t713 is timing immediately after the motor 91 is activated at time t703, and the effect of the increased driving speed of the motor 91 has little impact. Time t713 can be said to be almost the same timing as that at which the photosensitive drum 1Y and the developing roller 3Y are separated when the motor 91 is driven at the normal speed (100% speed). For the C station, in FIG. 8A, time t735 is timing at which the photosensitive drum 1C and the developing roller 3C are separated when the motor 91 is driven at the normal speed (100% speed). Time t734 is timing at which the photosensitive drum 1C and the developing roller 3C are separated when the motor 91 is driven at a speed (150% speed) 1.5 times the normal speed (see FIG. 8A, state (d)). Time t733 is timing at which the photosensitive drum 1C and the developing roller 3C are separated when the motor 91 is driven at a speed (125% speed) 1.25 times the normal speed (see FIG. 8A, state (d)).

An auxiliary line Lb illustrated in FIG. 8A connects times t713 and t733. An auxiliary line La connects times t713 and t735. An auxiliary line Lc connects times t713 and t734. A time width (time difference) between times t732 and t735 is almost the same as the time width Ta between times t712 and t713. A time difference between times t735 and t733 will be referred to as a time difference Tb. A time difference between times t735 and t734 will be referred to as a time difference Tc.

In FIG. 8B, an auxiliary line Mc connects times t511 and t531. Time t514 is timing at which the photosensitive drum 1Y and the developing roller 3Y of the Y station come into contact if the contact sequence is executed by driving the motor 91 at the normal speed (100%) and the photosensitive drum 1C and the developing roller 3C of the C station come into contact at time t531. An auxiliary line Ma connects times t531 and t514. A time width (time difference) between times t531 and t532 is the same as the time width between times t514 and t512. This time width is the same as the time width Ta illustrated in FIG. 8A described above. In state (d) of FIG. 8A, the time width Tc refers to a time width between time t734 when the reduced separation sequence is executed with the motor 91 at a speed 1.5 times (150%) the normal speed and time t735 when the separation sequence is executed at the normal speed (100%). In state (b) of FIG. 8B, time t511 is timing at which the photosensitive drum 1Y and the developing roller 3Y come into contact if the reduced contact sequence is executed by driving the motor 91 at a speed 1.5 times (150%) the normal speed. A time width between times t514 and t511 is thus the same as the time width Tc between times t734 and t735.

From FIGS. 8A and 8B, a relationship between the time differences Tc and Tb can be expressed by the following Eq. (1):

$$Tc:Tb=(150\%-100\%):(125\%-100\%)=2:1 \quad (1)$$

From Eq. (1), the relationship between the time differences Tb and Tc can be expressed by the following Eq. (2):

$$Tb=Tc/2 \quad (2)$$

Suppose that the reduced contact sequence illustrated in FIG. 8B is executed once and the reduced separation sequence illustrated in FIG. 8A is executed twice. In such a case, an unnecessary contact time T1 of the photosensitive drum 1Y and the developing roller 3Y of the Y station can be expressed by the following Eq. (3):

$$T1=(Ta-Tc)+2Ta=3Ta-Tc \quad (3)$$

Similarly, suppose that the reduced contact sequence illustrated in FIG. 8B is executed once and the reduced separation sequence illustrated in FIG. 8A is executed twice. By using Eq. (2), an unnecessary contact time T3 of the photosensitive drum 1C and the developing roller 3C of the C station can be expressed by the following Eq. (4):

$$T3=Ta+2(Ta-Tb)=3Ta-2Tb=3Ta-Tc \quad (4)$$

From Eqs. (3) and (4), the unnecessary contact time T1 of the Y station and the unnecessary contact time T3 of the C station are found to have the same time widths. In the present exemplary embodiment, if the reduced separation sequence is executed twice while the reduced contact sequence is executed once, the contact times of the Y, M, and C stations have the same time widths. The amounts of wear of the photosensitive drums 1 and the developing rollers 3 can thus be reduced and made uniform, whereby the times to replace the Y, M, and C stations can be made to coincide.

<Contact and Separation Control Sequences of Photosensitive Drums and Developing Rollers>

Figure 9:
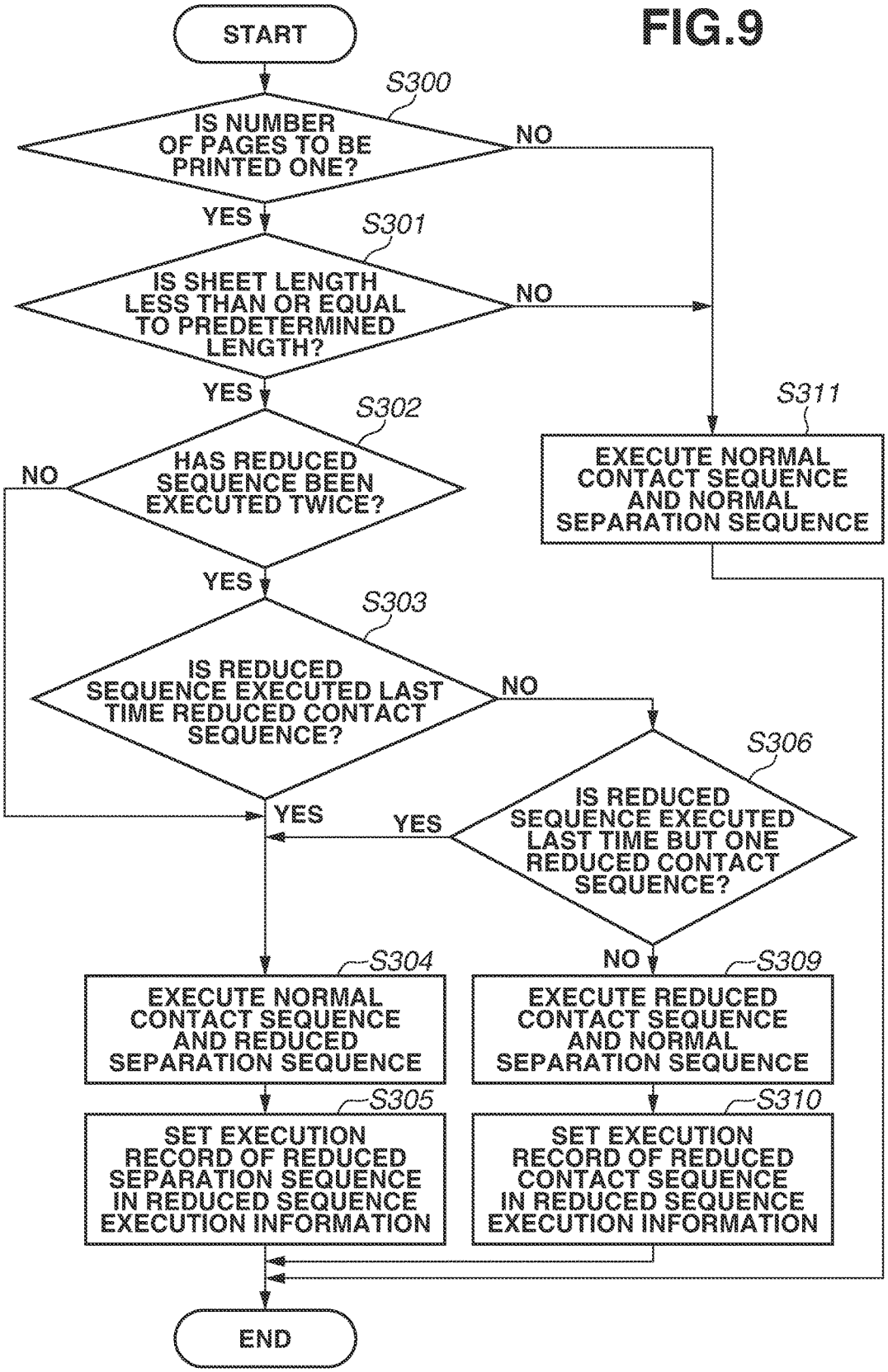
FIG. 9 is a flowchart illustrating developing contact and separation control sequences according to one or more aspects of the present disclosure.

FIG. 9 is a flowchart illustrating a control sequence for controlling the contact and separated states of the photosensitive drums 1 and the developing rollers 3 of the printer 100 according to the present exemplary embodiment. The processing illustrated in FIG. 9 is started upon execution of a print job, and performed by the CPU 104 of the printer control unit 101. The number of pages to be printed and the sheet size of the print job are set in a print command transmitted from the controller 102 to the printer control unit 101. The nonvolatile memory 112 stores reduced sequence execution information in which an execution record is stored when the reduced separation sequence or the reduced contact sequence is executed.

The processes in steps S300, S301, and S311 is similar to those in steps S100, S101, and S110 according to the first exemplary embodiment. A description thereof will be omitted here. In step S302, the CPU 104 refers to the reduced sequence execution information stored in the nonvolatile memory 112, and determines whether a reduced sequence has been executed twice. More specifically, the CPU 104 determines whether the execution records of the previous and previous but one reduced separation sequences or reduced contact sequences are stored. If the CPU 104 determines that the execution records of two reduced sequences are stored (YES in step S302), the processing proceeds to step S303. If the CPU 104 determines that the execution records of two reduced sequences are not stored (NO in step S302), the processing proceeds to step S304.

In step S303, the CPU 104 refers to the reduced sequence execution information stored in the nonvolatile memory 112, and determines whether the reduced sequence executed last time is the reduced contact sequence. If the CPU 104 determines that the reduced sequence executed last time is the reduced contact sequence (YES in step S303), the processing proceeds to step S304. If the CPU 104 determines that the reduced sequence executed last time is not the reduced contact sequence (is the reduced separation sequence) (NO in step S303), the processing proceeds to step S306. In step S306, the CPU 104 refers to the reduced sequence execution information stored in the nonvolatile memory 112, and determines whether the reduced sequence executed last time but one is the reduced contact sequence. If the CPU 104 determines that the reduced sequence executed last time but one is the reduced contact sequence (YES in step S306), the processing proceeds to step S304. If the CPU 104 determines that the reduced sequence executed last time but one is not the reduced contact sequence (is the reduced separation sequence) (NO in step S306), the processing proceeds to step S309.

In step S304, when bringing the photosensitive drums 1 and the developing rollers 3 into contact, the CPU 104 executes the contact sequence with the motor 91 at the normal speed (100% speed). When separating the photosensitive drums 1 and the developing rollers 3, the CPU 104 executes the reduced separation sequence with the motor 91 at 1.25 times speed (125% speed) (see FIG. 8A). In step S305, the CPU 104 sets the execution record of the reduced separation sequence in the reduced sequence execution information. The processing ends.

In step S309, when bringing the photosensitive drums 1 and the developing rollers 3 into contact, the CPU 104 executes the reduced contact sequence with the motor 91 at 1.5 times speed (150% speed). When separating the photosensitive drums 1 and the developing rollers 3, the CPU 104 executes the separation sequence with the motor 91 at the normal speed (100% speed) (see FIG. 8B). In step S310, the CPU 104 sets the execution record of the reduced contact sequence in the reduced sequence execution information. The processing ends.

In the present exemplary embodiment, the reduced separation sequence or the reduced contact sequence is described to be executed in a print job for performing one-sided printing on a sheet having a predetermined size or smaller. The reduced sequences described in the present exemplary embodiment are also applicable when two-sided printing is performed on a sheet as described in the second exemplary embodiment. More specifically, suppose that two-sided printing on a sheet is performed for the first time. When the first page is printed, the motor 91 is driven at a speed (125% speed) 1.25 times the normal speed during the reduced separation sequence for separating the photosensitive drums 1 and the developing rollers 3 in contact. When the second page is printed, the motor 91 is driven at a speed (150% speed) 1.5 times the normal speed during the reduced contact sequence for bringing the photosensitive drums 1 and the developing rollers 3 into contact. The motor 91 is driven at the normal speed during the separation sequence. Next, the two-sided printing is performed for the second time. When the first page is printed, the motor 91 is driven at a speed (125% speed) 1.25 times the normal speed during the reduced separation sequence for separating the photosensitive drums 1 and the developing rollers 3 in contact. When the second page is printed, the normal contact and separation sequences in which the motor 91 is driven at the normal speed (100% speed) are executed in both bringing into contact and separating the photosensitive drums 1 and the developing rollers 3. As a result, the reduced separation sequence is executed twice while the reduced contact sequence is executed once. This can make the contact times of the photosensitive drums 1 and the developing rollers 3 of the Y, M, and C stations the same and make the rates of wear to coincide. The amounts of wear of the photosensitive drums 1 and the developing rollers 3 can thus be reduced and made uniform, whereby the times to replace the Y, M, and C stations can be made to coincide.

In the present exemplary embodiment, the torque of the developing contact/separation mechanism during separation is high. The driving speed of the motor 91 in the reduced separation sequence is therefore set to be lower than that in the reduced contact sequence. Conversely, for example, in a configuration in which the torque of the developing contact/separation mechanism during contact is high, the driving speed of the motor 91 in the reduced contact sequence may be controlled to be low. In the present exemplary embodiment, the reduced contact sequence is described to be executed once and the reduced separation sequences twice based on the driving speed of the motor 91. If the driving speed needs to be further reduced due to torque on the motor 91, the ratio between the numbers of times of the sequences may be changed accordingly. For example, the driving speed of the motor 91 in the reduced contact sequence will be referred to as a second speed, the driving speed of the motor 91 in the reduced separation sequence as a fourth speed, and the driving speeds of the motor 91 in the normal contact and separation sequences as a first speed and a third speed, respectively. Suppose that the second and fourth speeds are different speeds, and the speed differences between the driving speeds of the reduced contact and separation sequences and the normal driving speeds have a proportional relationship of (second speed−first speed):(fourth speed−third speed)=M:N. In such a case, the reduced contact and separation sequences are executed so that the ratio of the numbers of times of execution of the reduced contact sequence and the reduced separation sequence is N:M. This makes the contact times of the photosensitive drums 1 and the developing rollers 3 of the Y, M, and C stations the same. The rates of wear can thus be made to coincide. As a result, the amounts of wear of the photosensitive drums 1 and the developing rollers 3 can be reduced and made almost the same, whereby the times to replace the Y, M, and C stations can be made to coincide.

As described above, according to the present exemplary embodiment, the unnecessary contact times of the photosensitive drums and the developing rollers of the image forming units can be reduced, and unevenness in the contact times of the photosensitive drums and the developing rollers of the image forming units can be reduced.

According to an exemplary embodiment of the present disclosure, the unnecessary contact times of the photosensitive drums and the developing rollers of the image forming units can be reduced, and unevenness in the contact times of the photosensitive drums and the developing rollers of the image forming units can be reduced.

While the present disclosure has been described with reference to exemplary embodiments, the scope of the following claims is to be accorded the broadest interpretation so as to encompass all such modifications and equivalent structures and functions.

This application claims the benefit of Japanese Patent Application No. 2016-179619, filed Sep. 14, 2016, which is hereby incorporated by reference herein in its entirety.

What is claimed is:

1. An image forming apparatus comprising:

a plurality of image forming units including respective photosensitive drums, and developing rollers configured to develop latent images formed on the photosensitive drums;

a contact/separation unit configured to shift the photosensitive drums and the developing rollers of the plurality of image forming units from a separated state to a contact state or from the contact state to the separated state;

a driving unit configured to drive the contact/separation unit; and a control unit configured to execute a first contact control, in which the driving unit is driven at a first speed and the photosensitive drums and the developing rollers of the plurality of image forming units are shifted from the separated state to the contact state, or a second contact control, in which the driving unit is driven at a second speed higher than the first speed and the photosensitive drums and the developing rollers of the plurality of image forming units are shifted from the separated state to the contact state, and execute a first separation control, in which the driving unit is driven at a third speed and the photosensitive drums and the developing rollers of the plurality of image forming units are shifted from the contact state to the separated state, or a second separation control, in which the driving unit is driven at a fourth speed higher than the third speed and the photosensitive drums and the developing rollers of the plurality of image forming units are shifted from the contact state to the separated state, wherein the control unit is configured to select which contact control to execute, the first contact control or the second contact control, and which separation control to execute, the first separation control or the second separation control, according to a size of a sheet for image formation, and wherein the control unit is configured to select the contact control and the separation control so that a difference between a number of times of execution of the second contact control and a number of times of execution of the second separation control becomes less than or equal to a predetermined number of times.

2. The image forming apparatus according to claim 1, wherein the control unit is configured to, in a case where the sheet for image formation has a length less than or equal to a predetermined length in a conveyance direction and image formation is performed on one sheet, execute the second contact control or the second separation control.

3. The image forming apparatus according to claim 2, further comprising an intermediate transfer member onto which images developed on the photosensitive drums of the plurality of image forming units are transferred, wherein, in a case where the control unit executes the first contact control to perform the image formation on the sheet, timing at which development by the developing roller of a most upstream image forming unit in a rotation direction of the intermediate transfer member among the plurality of image forming units ends is earlier than timing at which the photosensitive drums and the developing rollers of all the image forming units shift to the contact state.

4. The image forming apparatus according to claim 3, wherein, in a case where the control unit executes the second contact control, contact times of the photosensitive drums and the developing rollers are such that the more downstream an image forming unit is arranged in the rotation direction of the intermediate transfer member among the plurality of image forming units, the longer the contact time of the photosensitive drum and the developing roller of the image forming unit is, and wherein, in a case where the control unit executes the second separation control, the contact times of the photosensitive drums and the developing rollers are such that the more upstream an image forming unit is arranged in the rotation direction of the intermediate transfer member among the plurality of image forming units, the longer the contact time of the photosensitive drum and the developing roller of the image forming unit is.

5. The image forming apparatus according to claim 4, wherein the control unit is configured to make a difference between the contact times of the photosensitive drums and the developing rollers of the image forming units other than one image forming unit among the plurality of image forming units less than or equal to a predetermined time.

6. The image forming apparatus according to claim 5, wherein the one image forming unit is an image forming unit arranged most downstream in the rotation direction of the intermediate transfer member among the plurality of image forming units.

7. The image forming apparatus according to claim 5, wherein the predetermined number of times is a maximum integer value less than or equal to (Tp/Td), where Tp is the predetermined time, and Td is a time difference with which the photosensitive drums and the developing rollers of the plurality of image forming units come into contact with each other when the second contact control is executed or a time difference with which the photosensitive drums and the developing rollers of the plurality of image forming units are separated when the second separation control is executed.

8. The image forming apparatus according to claim 7, wherein the predetermined time is contact times of the photosensitive drums and the developing rollers in a case where the first contact control and the first separation control are executed to perform one-sided printing on one sheet.

9. The image forming apparatus according to claim 7, wherein, in a case where the second speed is higher than the fourth speed, Td is the time difference with which the photosensitive drums and the developing rollers of the plurality of image forming units come into contact with each other when the second contact control is executed, and wherein, in a case where the fourth speed is higher than the second speed, Td is the time difference with which the photosensitive drums and the developing rollers of the plurality of image forming units are separated when the second separation control is executed.

10. The image forming apparatus according to claim 2, wherein the first and third speeds are substantially the same speeds, and the second and fourth speeds are substantially the same speeds.

11. The image forming apparatus according to claim 10, wherein the control unit is configured to, in a case where one-sided printing is performed on the sheet, alternately execute the second contact control and the second separation control.

12. The image forming apparatus according to claim 11, further comprising a two-sided conveyance path configured to convey a sheet for two-sided printing, wherein the control unit is configured to, in a case where the two-sided printing is performed on the sheet, execute the first contact control and the second separation control when an image is formed on a front of the sheet, then convey the sheet to the two-sided conveyance path to form an image on a back of the sheet, and execute the second contact control and the first separation control when an image is formed on the back of the sheet.

13. The image forming apparatus according to claim 2, wherein the control unit is configured to, in a case where the first and third speeds are substantially the same speeds, the second and fourth speeds are different speeds, and (the second speed−the first speed):(the fourth speed−the third speed) has a proportional relationship of M:N, execute the second contact control and the second separation control so that a ratio of the numbers of times of execution of the second contact control and the second separation control becomes N:M.

* * * * *